US012727671B2

(12) United States Patent
Ruiz et al.

(10) Patent No.: US 12,727,671 B2
(45) Date of Patent: Sep. 8, 2026

(54) MODULAR SHELVING SYSTEM AND METHOD FOR USING THE SAME

(71) Applicant: Cambro Manufacturing Company, Huntington Beach, CA (US)

(72) Inventors: Abraham Ruiz, Anaheim, CA (US); Jorge Baez, Lake Forest, CA (US)

(73) Assignee: CAMBRO MANUFACTURING COMPANY, Huntington Beach, CA (US)

( * ) Notice: Subject to any disclaimer, the term of this patent is extended or adjusted under 35 U.S.C. 154(b) by 326 days.

(21) Appl. No.: 18/354,197

(22) Filed: Jul. 18, 2023

(65) Prior Publication Data

US 2025/0024945 A1 Jan. 23, 2025

(51) Int. Cl.
*A47B 96/02* (2006.01)
*A47F 5/00* (2006.01)

(52) U.S. Cl.
CPC ..... *A47B 96/028* (2013.01); *A47F 5/005* (2013.01); *A47F 5/0068* (2013.01)

(58) Field of Classification Search
None
See application file for complete search history.

(56) References Cited

U.S. PATENT DOCUMENTS 392,061 A * 10/1888 Peckham ..... A47B 57/42 5/294
3,040,905 A * 6/1962 Gingher ..... A47F 5/103 211/183
3,212,836 A * 10/1965 Johnson ..... F25D 25/02 312/351
4,098,480 A * 7/1978 Neumann ..... A47B 96/028 248/242
5,062,605 A * 11/1991 Muhlethaler ..... H02G 3/0443 248/68.1
5,069,408 A * 12/1991 Bessinger ..... A47B 96/061 211/187

(Continued)

FOREIGN PATENT DOCUMENTS

AU 2003257901 B2 * 10/2008 ..... A47B 96/1416
CA 2011580 A1 * 9/1990 ..... A47B 57/26

(Continued)

*Primary Examiner* — Hanh V Tran
(74) *Attorney, Agent, or Firm* — MH2 Technology Law Group, LLP

(57) ABSTRACT

A shelving system comprising a track which is coupled to a wall or other fixed object and at least one upright that is configured to hang on the track. The shelving system also comprises at least one removable bracket which can be coupled to the upright at a plurality of different vertical heights. Disposed on or coupled to the bracket is a removable frame which is configured to be a platform for providing the user a number of different storage or item management options. The shelving system also comprises a pegboard which is removably coupled to the upright. A plurality of different attachment units may be removably coupled to the pegboard to give the user additional options for storing or maintaining goods or items therein. The shelving system also comprises a modular design so that additional removable frames and/or pegboards may be added or removed as is required.

21 Claims, 43 Drawing Sheets

(56) References Cited

U.S. PATENT DOCUMENTS 5,333,746 A * 8/1994 Bustos ..... A47B 57/00 248/242
5,472,103 A * 12/1995 Merl ..... A47B 47/022 211/187
5,868,263 A * 2/1999 McAllister ..... A47B 57/485 248/249
6,315,135 B1 * 11/2001 Stuart ..... A47B 57/04 211/187
6,659,295 B1 * 12/2003 De Land ..... A47B 96/04 211/187
6,823,999 B2 * 11/2004 Heneveld, Sr. ..... A47B 96/02 211/100
6,848,589 B2 * 2/2005 Wood ..... A47B 96/1416 248/220.21
7,337,730 B2 * 3/2008 Bienick ..... F25D 25/02 108/108
7,497,344 B2 * 3/2009 Chen ..... A47B 96/028 248/220.42
7,900,783 B2 * 3/2011 Fernandez ..... F16B 25/0057 211/90.03
9,277,814 B2 * 3/2016 Winker ..... A47B 96/02
10,709,237 B2 * 7/2020 Robinson ..... A47B 96/028
11,369,215 B2 * 6/2022 Obitts ..... A47F 5/0043
12,329,280 B2 * 6/2025 Li ..... A47B 96/028
2005/0109720 A1 * 5/2005 Marchetta ..... A47B 96/1458 211/90.03
2009/0107936 A1 * 4/2009 Scriba ..... A47F 5/13 211/88.01

FOREIGN PATENT DOCUMENTS

CN 211154632 U * 8/2020
CN 218419547 U * 2/2023
EP 0003800 A1 * 9/1979 ..... A47B 96/028
ES 303299 A1 * 11/1964 ..... A47F 5/0025
KR 20120008062 U * 11/2012 ..... A47F 5/0807
WO WO-9529610 A1 * 11/1995 ..... A47B 57/00
WO WO-9615700 A1 * 5/1996 ..... A47B 57/00
WO WO-2022074511 A1 * 4/2022 ..... B25H 3/04

* cited by examiner

MODULAR SHELVING SYSTEM AND METHOD FOR USING THE SAME

BACKGROUND

Field of the Technology

The invention relates to the field of shelving and shelving systems, particularly to shelving units which are easily customizable and may be modularly constructed.

Description of the Prior Art

Utility or commercial shelving units or shelving systems comprised of different types of materials have long been used in art. Many of these prior art shelving systems have a plurality of shelves which can either be fixed at certain predetermined heights or may be adjustable to one of a series of available heights using an adjustable coupling means such as clamps, buckles, or sliding and locking mounts. Some shelving systems also include drawers or cabinets as well. Some shelving units or systems are free standing, while others may be permanently or temporarily coupled or affixed to a wall, barrier, or other piece of furniture.

However, while many wall mounted shelving units can their individual shelves adjusted, the overall size or footprint of the shelving unit is often static and cannot be further adjusted to include additional shelving space. Additionally, many shelving units comprise a single configuration which cannot be altered to meet the specific needs of a user, for example the shelf unit includes either a flat surface for accommodating dishware, or a suspended basket or other container in which items can be placed, but no means for the user to change or swap between configurations as needed.

In many cases, in shelving systems with shelves that may be adjusted to a user determined height, the means for coupling the shelves to their support posts and/or supports can be overly complicated or inconvenient. Adjustable coupling means that are too complicated are more prone to malfunction and can add additional unnecessary weight to the shelving system. Inconvenient coupling means may similarly be difficult to use or require at least two people to operate.

Relatedly, many shelving units or shelving systems are manufactured in multiple parts which are delivered to the consumer who must then assemble the shelving unit before using it. Cumbersome or overly complicated coupling means not only make the shelving system more difficult or inconvenient to use, but the more complicated the means for assembling the shelf unit, the more likely that the user will improperly construct the shelf unit.

What is needed is a shelving system that is customizable so as to provide a number of different shelving options to meet a user's current needs. The shelving system should also provide means for adjusting its overall size, thereby providing additional or less shelf space as is needed. Additionally, the shelving system should be easily assembled from a minimum number of parts in such a manner so as to prevent a user from incorrectly constructing the shelving system and potentially compromising its structural integrity in the process.

BRIEF SUMMARY

The current invention provides a shelving system comprising a track, a first upright removably coupled to the track, a second upright removably coupled to the track, and a first shelving item removably coupled between the first upright and the second upright. The first shelving item itself comprises a frame or a pegboard.

In one embodiment, the shelving system further comprises a first bracket removably coupled to the first upright, and a second bracket removably coupled to the second upright. The frame comprises a pair of longitudinal edges and a pair of lateral edges, the pair of lateral edges each being configured to removably couple to the first bracket and the second bracket, respectively. Additionally, the first upright and the second upright each comprise a plurality of hooks that are disposed along their respective vertical heights, the first bracket and the second bracket each comprising a plurality of flanges that are configured to engage with a selected sub-plurality of the plurality of hooks disposed on the first upright and the second upright, respectively. Alternatively, in a related embodiment, each of the lateral edges of the frame comprises at least two joints, while the first bracket and the second bracket each comprise a plurality of proximal pins and a plurality of distal pins disposed a top surface. The at least two joints of each of the lateral edges are specifically configured to removably couple to at least one of the plurality of proximal pins or at least one of the plurality of distal pins when the lateral edges of the frame are disposed on the top surfaces of the first and second brackets. Additionally, according to certain embodiments, at least one cutting board is also removably coupled to the first bracket or the second bracket.

In another embodiment, the shelving system further comprises at least one shelf plate that is removably inserted into the frame.

In a further embodiment, the shelving system further comprises a second shelving item that is removably coupled between the first upright and the second upright, the second shelving item also comprising a frame or a pegboard.

In another embodiment, the first upright and the second upright of the shelving system each comprise a plurality of hooks disposed along their respective vertical heights. Furthermore, the pegboard in this embodiment comprises a body, a plurality of holes defined in the body, and a plurality of hook apertures that are defined in the body. The plurality of hook apertures are specifically configured to engage with a sub-plurality of the plurality of hooks of the first and second uprights. Additionally, at least one attachment unit is removably coupled to the pegboard, the at least one attachment unit including a wire frame coupled to a cup, a basket, a plurality of pegs, or a bin. In a related embodiment, the wire frame comprises at least one reversible attachment, the at least one reversible attachment comprising an eye defined in a first end and a tab disposed in a second end of the at least one reversible attachment.

In a further embodiment, the shelving system further comprises at least one drying rack that is removably inserted into the frame.

In a further embodiment, the shelving system further comprises at least one barrier that is removably coupled to the frame. According to certain embodiments, the barrier comprises a plurality of posts, and a rail disposed between the plurality posts. Each of the plurality of posts comprises a clamp that is configured to couple to the frame.

In one embodiment, the shelving system further comprises at least one partition that is removably inserted into the frame. In certain embodiments, at least one bin is also removably inserted into the frame and disposed on a top surface of the at least one partition.

The current invention also provides a method for assembling a shelving system. The method comprises removably coupling a first upright to a first selected location along a length of a track, removably coupling a second upright to a second selected location along the length of the track, and then removably coupling a first shelving item to the first upright and the second upright. Removably coupling the first shelving item to the first upright and the second upright specifically includes either removably coupling a frame to the first upright and the second upright, or removably coupling a pegboard to the first upright and the second upright.

In one embodiment, removably coupling the frame to the first upright and the second upright comprises removably coupling a first bracket to the first upright, removably coupling a second bracket to the second upright, and then removably coupling the frame to both the first bracket and the second bracket. Additionally, the steps of removably coupling the first bracket to the first upright and removably coupling the second bracket to the second upright specifically comprises inserting at least one flange disposed on the first bracket into at least one groove defined in the first upright, and then inserting at least one flange disposed on the second bracket into at least one groove defined in the second upright. More specifically, the step of removably coupling the frame to the first bracket and the second bracket comprises removably coupling a first joint of the frame to at least one distal pin disposed on a top surface of the first bracket, removably coupling a second joint of the frame to at least one proximal pin disposed on the top surface of the first bracket, and then removably coupling a third joint of the frame to at least one distal pin disposed on a top surface of the second bracket. Next, a fourth joint of the frame is removably coupled to at least one proximal pin disposed on the top surface of the second bracket. According to certain embodiments, the method also comprises inserting at least one shelf plate into the frame.

In another embodiment, the method includes removably coupling at least one attachment unit to the pegboard, the at least one attachment unit comprising a cup, a basket, a plurality of pegs, or a bin.

In a further embodiment, the method comprises removably coupling at least a second shelving item to the first upright and the second upright. More specifically, coupling the second shelving item to the first upright and the second upright comprises either removably coupling a frame to the first upright and the second upright, or removably coupling a pegboard to the first upright and the second upright.

The current invention also provides a method for expanding a shelving system. In one embodiment the method comprises decoupling a first shelving item from an upright, the upright being disposed at a first position along a length of a track, sliding the upright along the length of the track from the first position to a second position, and then recoupling the first shelving item to the upright. Next, a second shelving is coupled item to the upright. The method step of decoupling the first shelving item from the upright specifically comprises either decoupling a first frame from the upright, or decoupling a first pegboard from the upright.

In another embodiment, the method step of recoupling the first shelving item to the upright specifically comprises either recoupling the first frame to the upright, or recoupling the first pegboard to the upright. Additionally, coupling the second shelving item to the upright comprises either coupling a second frame to the upright, or coupling a second pegboard to the upright. Relatedly, recoupling the first frame to the upright comprises coupling at least one joint of the first frame to at least one of a pair of pins disposed on a top surface of a bracket coupled to the upright, and then coupling at least one joint of the second frame to a remaining one of the pair of pins disposed on the top surface of the bracket coupled to the upright. According to certain embodiments, recoupling the first pegboard to the upright comprises disposing a first plurality of hooks disposed on the upright through a plurality of hook apertures defined in the first pegboard, while coupling the second pegboard to the upright comprises disposing a second plurality of hooks disposed on the upright through a plurality of hook apertures defined in the second pegboard. In a related embodiment, the method also includes inserting at least one of a shelf plate, a drying rack, a barrier, or a partition into either the first frame or the second frame.

In a further embodiment, the method step of decoupling the first frame from the upright comprises removing at least one joint of the first frame from at least a pair of pins disposed on a top surface of a bracket coupled to the upright, or alternatively, the method step of decoupling the first pegboard from the upright comprises disengaging a plurality of hook apertures defined in the first pegboard from a corresponding plurality of hooks disposed on the upright.

In another embodiment, the method step of decoupling the first pegboard from the upright comprises removing a plurality of hook apertures defined in the first pegboard from a corresponding plurality of hooks disposed on the upright.

The current invention further provides a shelving system comprising a first bracket coupled to a wall, a second bracket coupled to the wall, and a frame coupled to the first bracket and the second bracket. The second bracket is disposed at a common vertical height along the wall relative to the first bracket. The first bracket and the second bracket each comprise a body, and a plurality of plates disposed on the body, wherein each of the plurality of plates extend in a substantially perpendicular direction relative to the body.

In one embodiment, the first bracket and the second bracket are each configured to couple to at least one stud of the wall.

In a further embodiment, each of the plurality of plates comprise an aperture configured to a receive a mechanical coupling means therein.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The disclosure can be better visualized by turning now to the following drawings wherein like elements are referenced by like numerals.

The disclosure and its various embodiments can now be better understood by turning to the following detailed description of the preferred embodiments which are presented as illustrated examples of the embodiments defined in the claims. It is expressly understood that the embodiments as defined by the claims may be broader than the illustrated embodiments described below.

DETAILED DESCRIPTION OF THE PREFERRED EMBODIMENTS

Figure 1A:
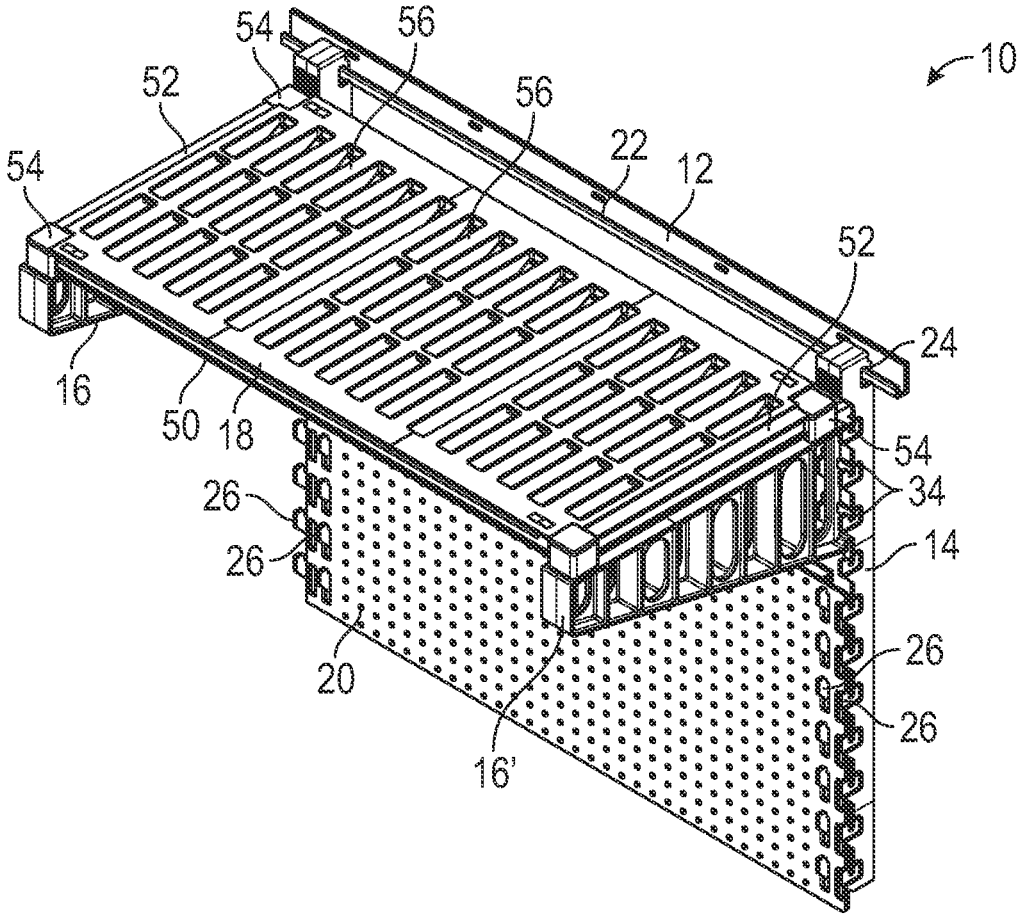
FIG. 1A is a perspective view of a shelving system of the current invention comprising a plurality of uprights coupled to a track and a pair of brackets and a pegboard that are in turn coupled to the plurality of uprights.
Figure 1B:
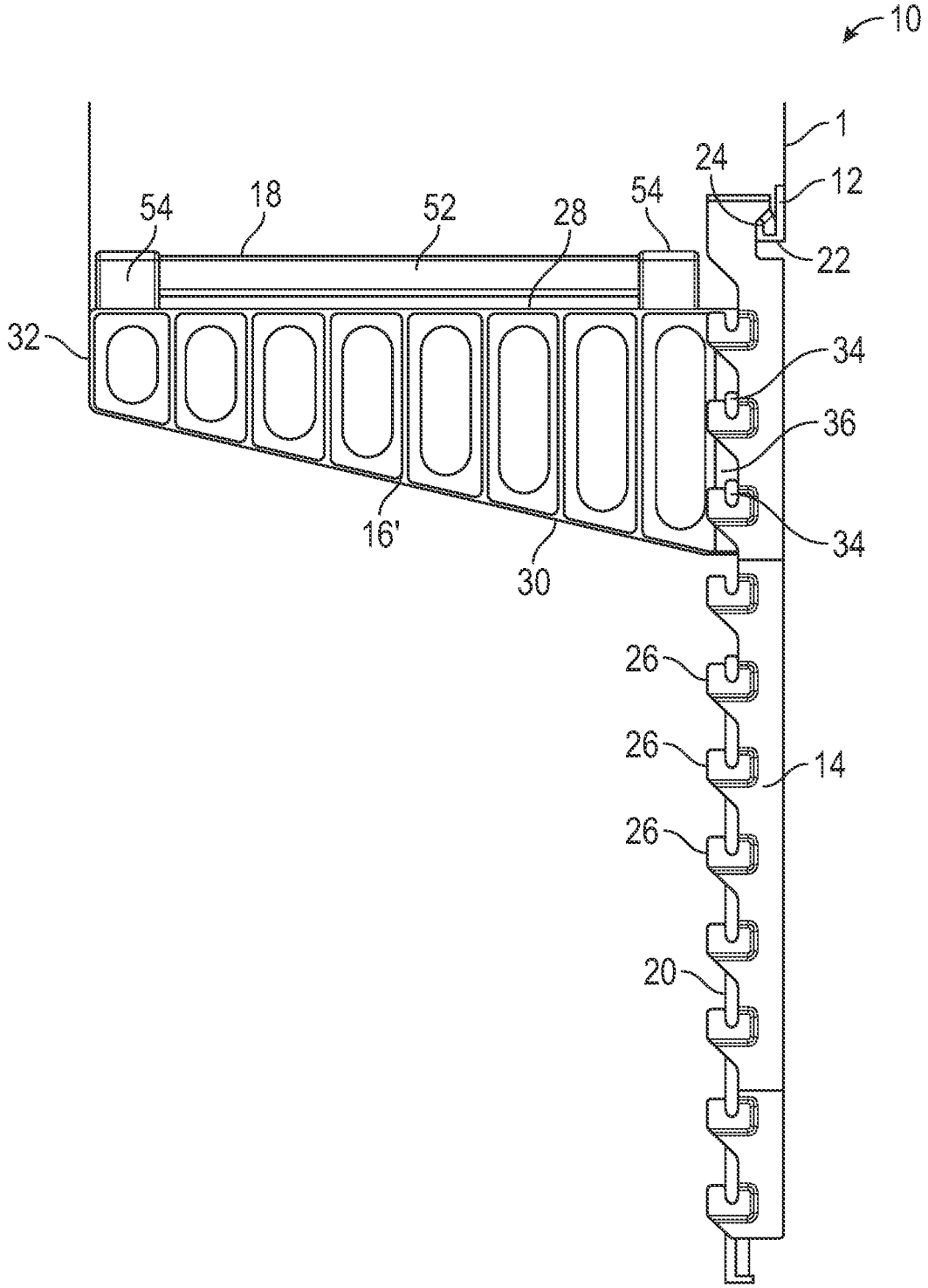
FIG. 1B is a right side elevational view of the shelving system of FIG. 1A.
Figure 1C:
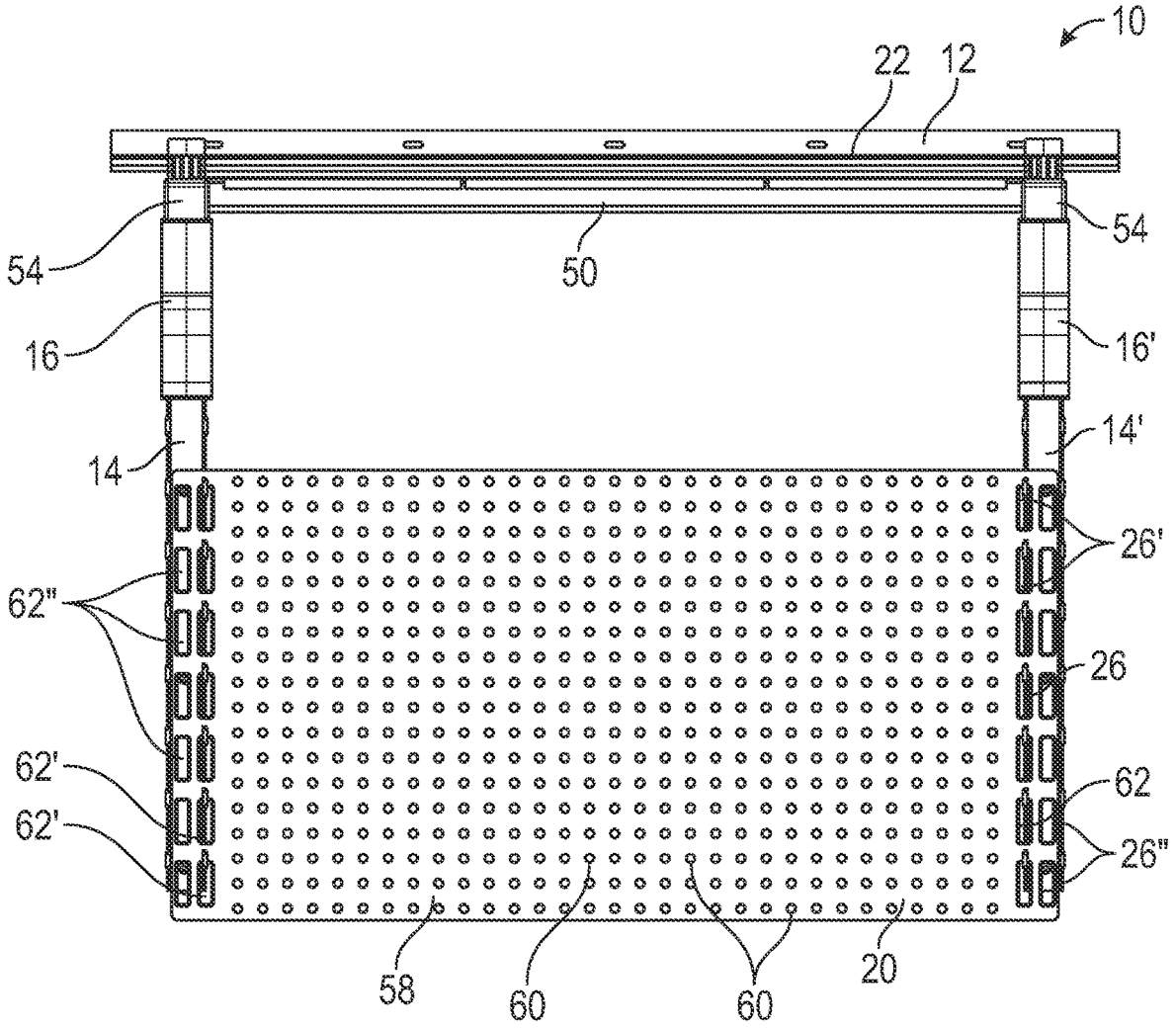
FIG. 1C is a front elevational view of the shelving system of FIG. 1A.

A first embodiment of the shelving system provided by the current invention may be seen in FIGS. 1A-1C where the shelving system is denoted generally by reference numeral 10. The shelving system 10 comprises a track 12 which is configured to be coupled to a wall or other fixed object and at least one upright 14 that is configured to hang on the track 12 as detailed further below. In certain embodiments, the shelving system 10 also comprises at least one removable bracket 16 which can be coupled to the upright 14 at a plurality of different vertical heights. According to certain embodiments, the shelving system 10 comprises at least one shelving item that is coupled to either the at least one upright 14 and/or the at least one bracket 16 which provides a user with a means to store, manage, or otherwise maintain a number of different goods or items thereon. For example, one type of shelving item comprises a removable frame 18 that is removably disposed on or coupled to the bracket 16, the frame 18 itself being configured to be a platform for providing the user a number of different storage or item management options. In certain embodiments, another type of shelving item of the shelving system 10 comprises a pegboard 20 which is removably coupled to the upright 14, the pegboard 20 likewise being configured to be another platform for providing the user a number of different storage or item management options as detailed further below.

In certain embodiments, the track 12 is comprised of aluminum however other relatively lightweight metal, plastic, or plastic composites may be used. The track 12 comprises an upturned lip or edge 22 disposed along its entire longitudinal length. The track 12 is coupled to a wall 1 as seen in FIG. 1B via any known coupling means including but not limited to nails, bolts, screws, adhesive, and/or glue.

Figure 2A:
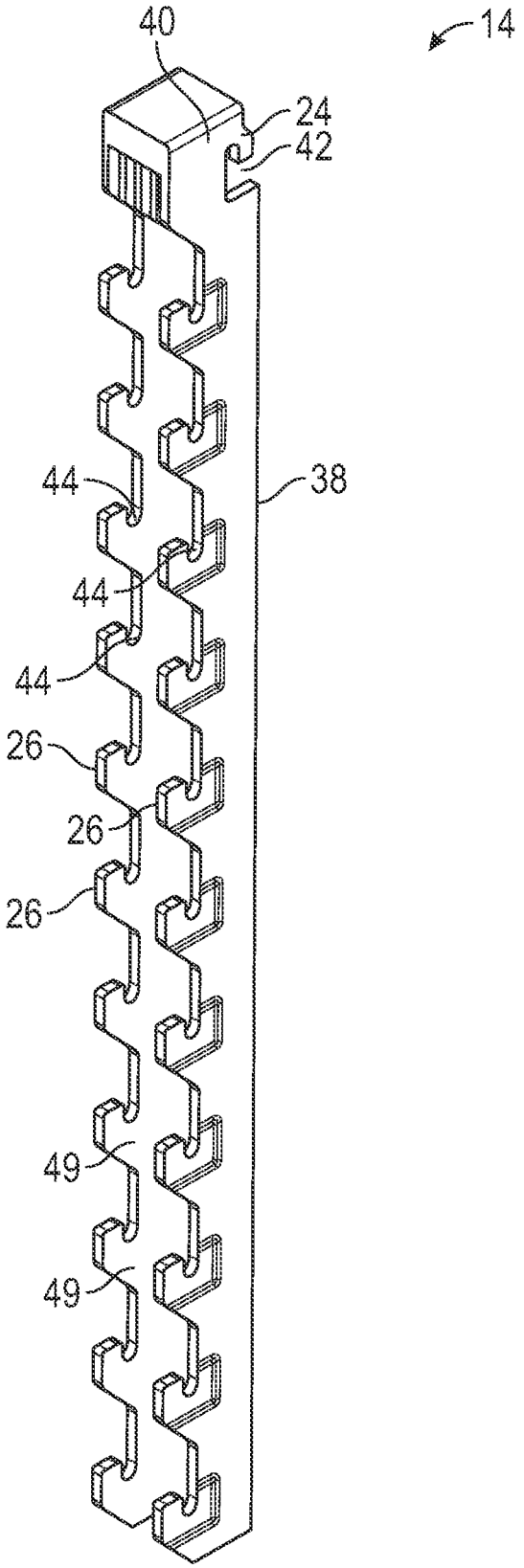
FIG. 2A is a perspective view of an upright used in the shelving system of FIG. 1A.
Figure 2B:
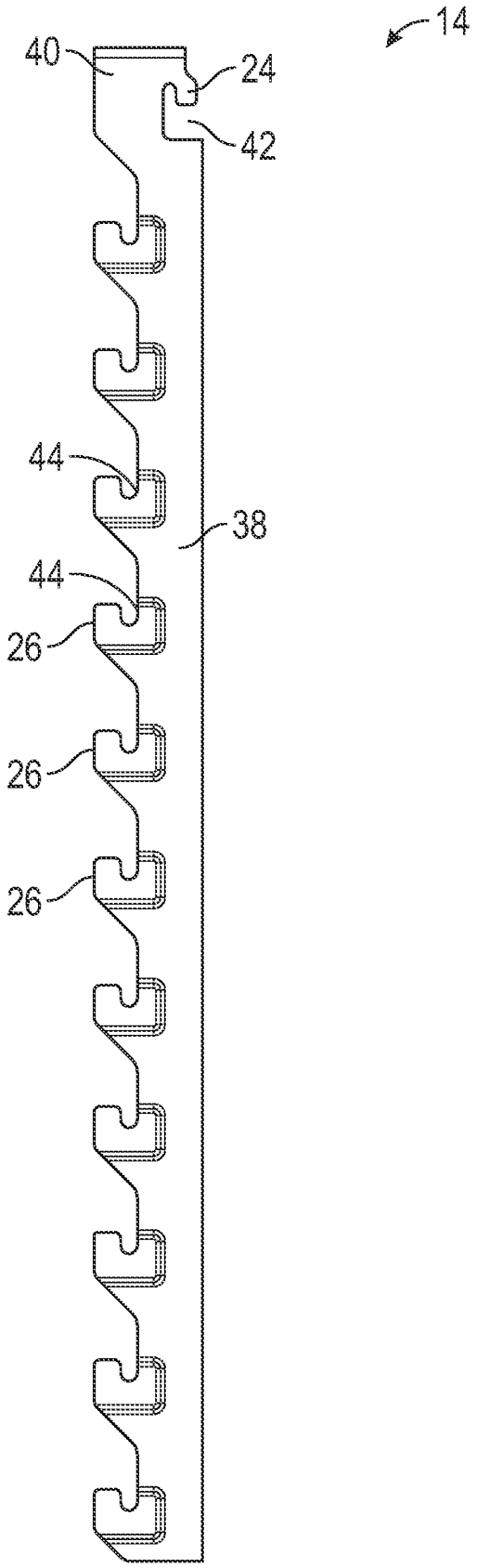
FIG. 2B is a right side elevational view of the upright of FIG. 2A.

Turning to FIGS. 2A and 2B, greater detail of the upright 14 may be seen. In certain embodiments, the upright 14 is comprised of a nylon body 38, however other light weight plastics or plastic composites may be used without departing from the original spirit and scope of the invention. The upright 14 comprises a catch 24 defined in one vertical end 40 thereof which is configured to form a nested or interlocking fit with the upturned edge 22 of the track 12. Specifically, the catch 24 comprises an edge aperture 42 comprises a mirror image configuration of the upturned edge 22 of track 12. A plurality of hooks 26 are disposed throughout a vertical height of the body 38, and in certain embodiments, the plurality of hooks 26 are disposed or arranged in two vertical lines down the body 38 so as to form a plurality of pairs or adjacently disposed hooks 26 with a space or gap 49 defined there between. Each of the plurality of hooks 26 comprises a vertical groove 44 defined in a corresponding upward facing surface.

Figure 3A:
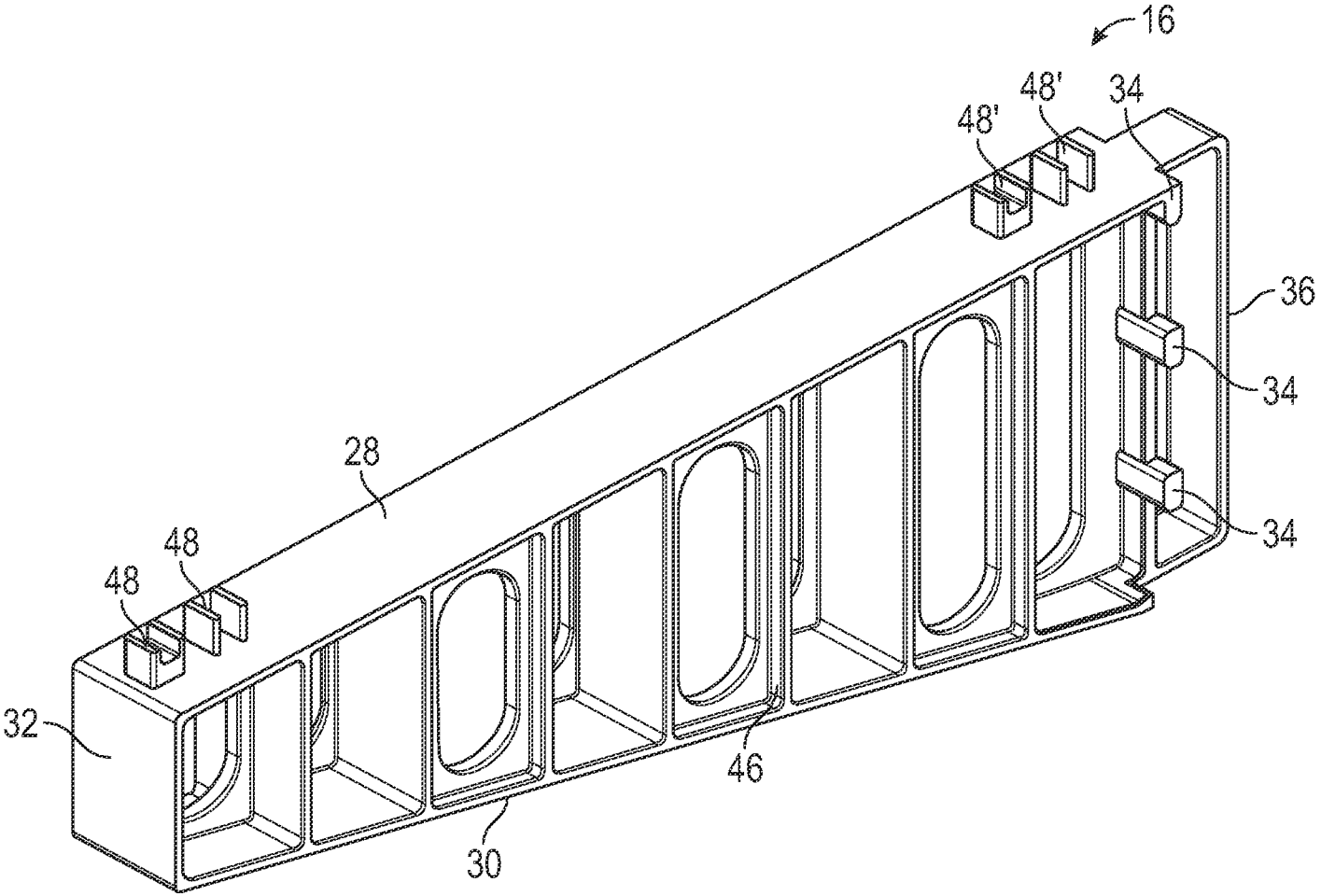
FIG. 3A is a perspective view of a bracket used in the shelving system of FIG. 1A.
Figure 3B:
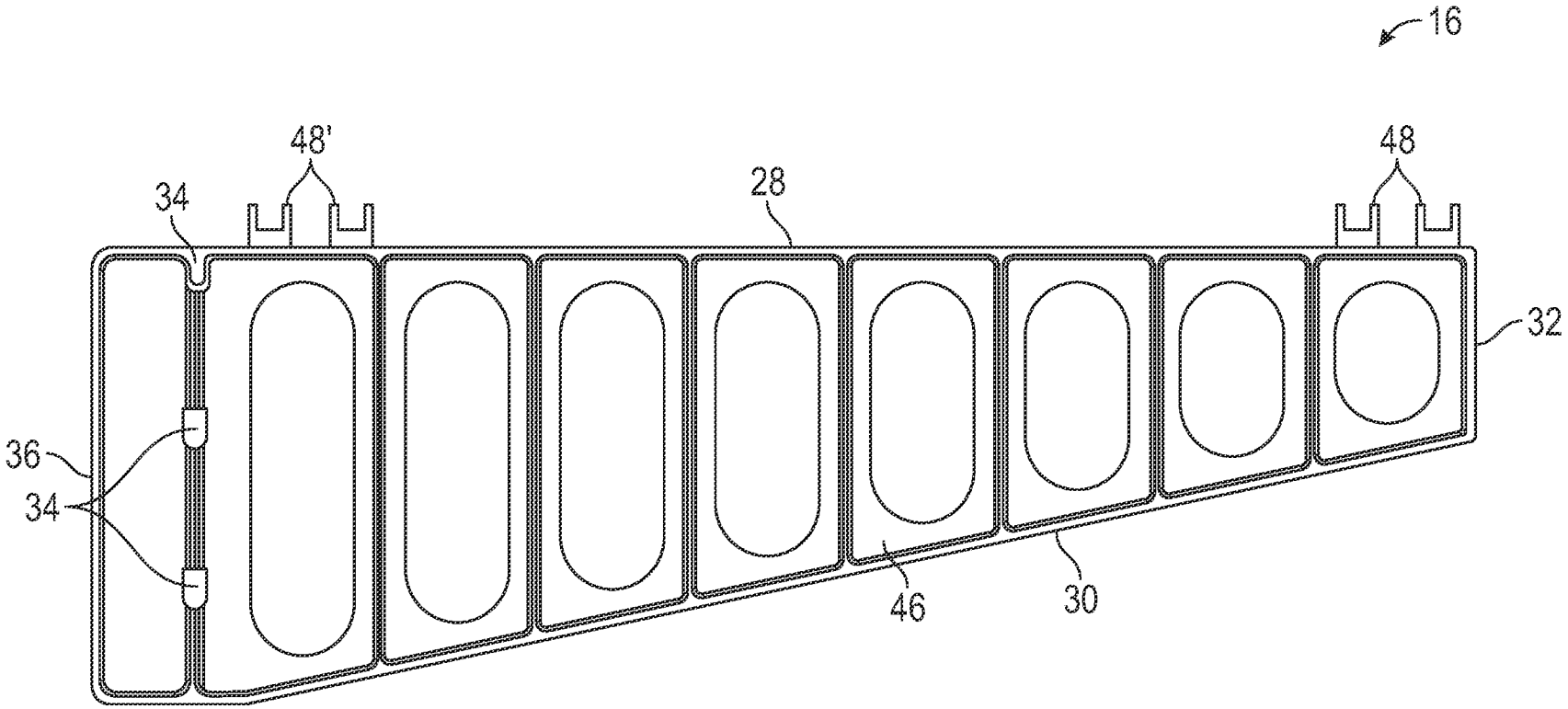
FIG. 3B is a left side elevation view of the bracket of FIG. 3A.

Turning to FIGS. 3A and 3B, greater detail of the bracket 16 may be seen. In certain embodiments, the bracket 16 comprises a body 46 of nylon, however other light weight plastics or plastic composites may be used without departing from the original spirit and scope of the invention. The bracket 16 comprises a top surface 28 and a bottom surface 30 joined together via a front surface 32 disposed at a proximal end of the bracket 16 and a back surface 36 disposed at a distal end of the bracket 16. In certain embodiments, the top surface 28 is substantially straight so as to provide a flat or horizontal surface when the bracket 16 is coupled to an upright as seen in FIG. 1B, while the bottom surface 30 is angled so at to provide the bracket 16 with a tapered vertical height, specifically with the bracket 16 comprising a narrow height adjacent to the front surface 32 which continuously and gradually widens until reaching a maximum height adjacent to the back surface 36. In other embodiments, the top surface 28 and/or the bottom surface 30 comprise straight, angled, or curved configurations so as to provide the shelving system 10 with a correspondingly straight, angled, or curved platform for supporting the frame 18 as detailed further below. In certain embodiments, adjacent to the back surface 36 are a plurality of projections or flanges 34 disposed along its vertical height, each flange 34 being disposed or extending outward in a parallel direction relative to the back surface 36 itself. Each of the plurality of flanges 34 comprise a rounded shape or bottom edge so that it may be slotted into or otherwise accommodated by any one of the grooves 44 defined in the plurality of hooks 26 of the upright 14. FIGS. 3A and 3B show three flanges 34 disposed on either lateral side of the bracket 16, however in certain embodiments, fewer, additional, or alternatively shaped flanges 34 may be used without departing from the original spirit and scope of the invention. Disposed on the top surface 28 of the bracket 16 are a plurality of proximal pins 48 and a plurality of distal pins 48', the proximal pins 48 being adjacently disposed to the front surface 32 and the distal pins 48' being adjacently disposed to the back surface 36. The pins 48, 48' are seen as being substantially square or rectangular with a substantially "U" shaped profile, however in certain embodiments, the pins 48, 48' may be rounded or comprise an alternative shape other that what is explicitly shown. The pins 48, 48' are also seen as being disposed in a vertical orientation down the longitudinal length of the top surface 28, however in other embodiments, both sets of pins 48, 48' are disposed in a side-by-side configuration, namely with each set of pins 48, 48' being laterally disposed across a segment or width of the top surface 28.

Figure 3C:
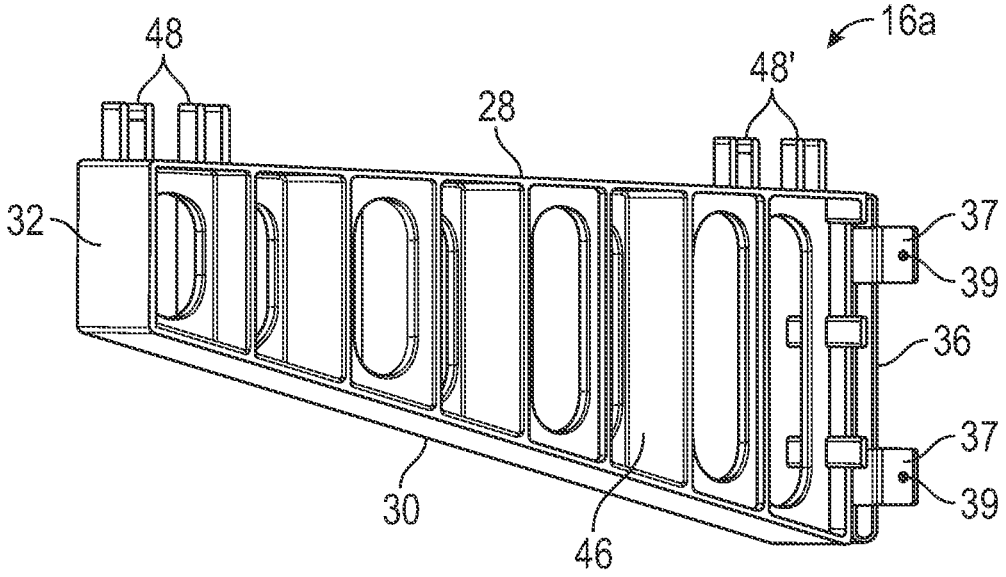
FIG. 3C is a frontal perspective view of an alternative embodiment of the bracket of FIG. 3A comprising a plurality of plates.
Figure 3D:
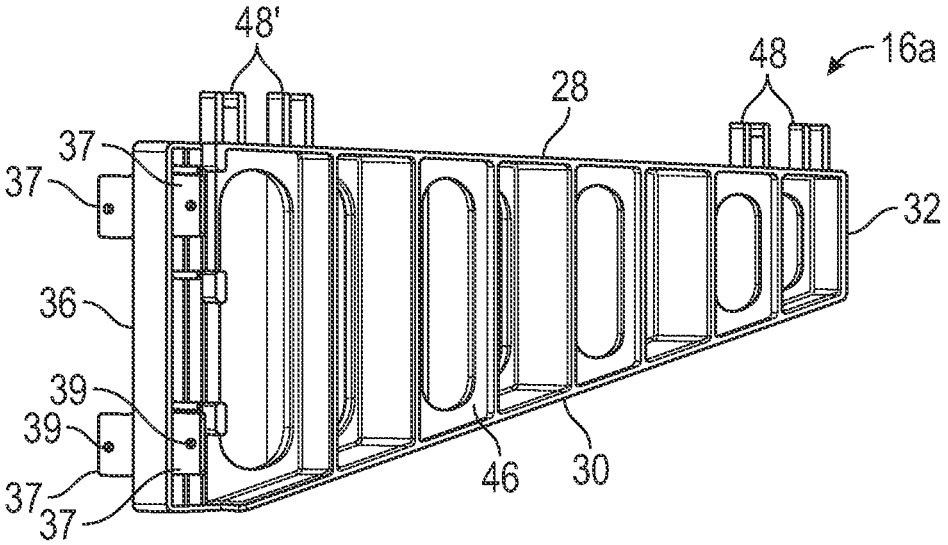
FIG. 3D is a rear perspective view of the alternative embodiment of the bracket of FIG. 3C.
Figure 3E:
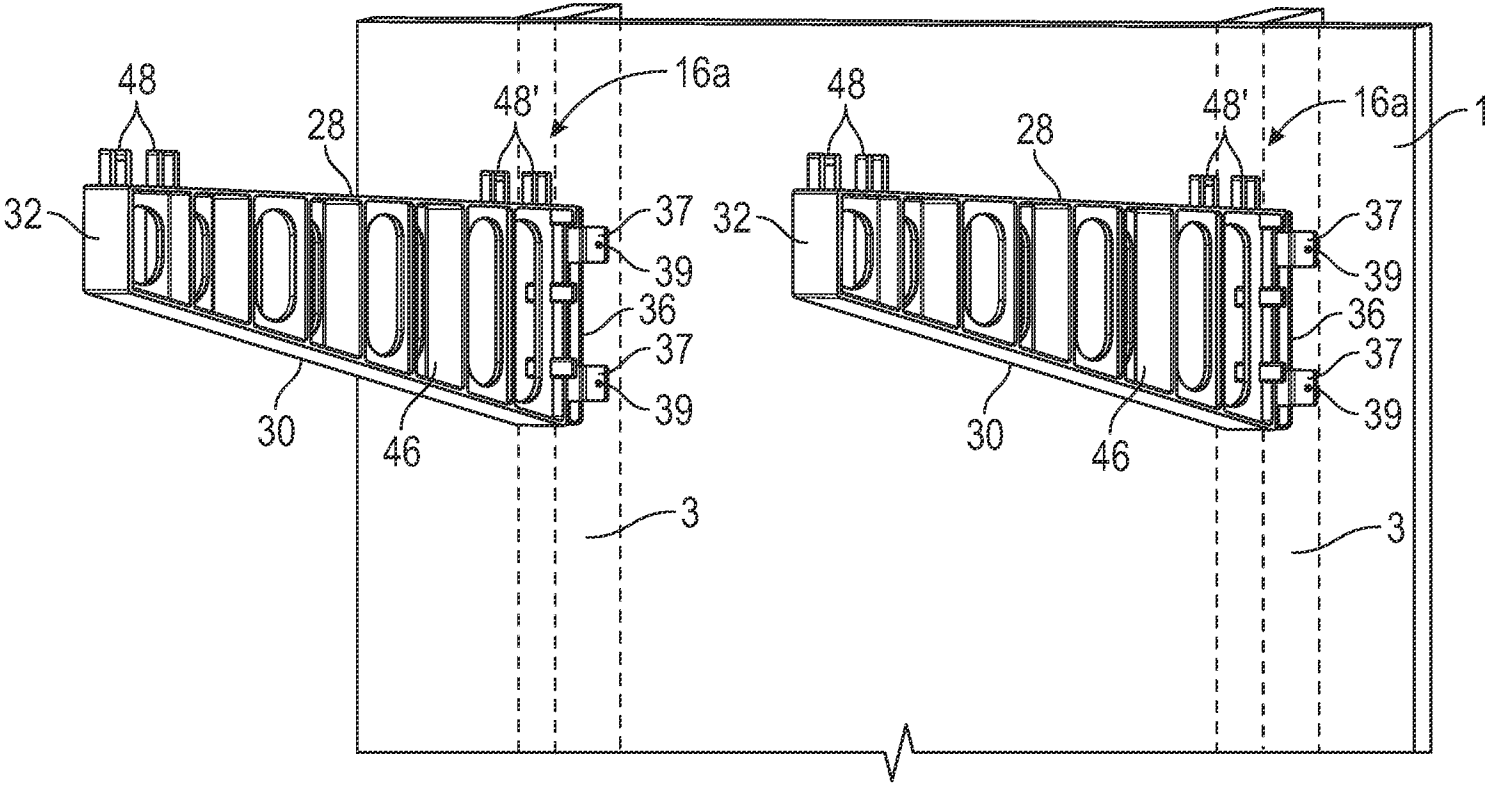
FIG. 3E is a frontal perspective view of the alternative embodiment of the bracket of FIG. 3C when directly coupled to wall.

In certain embodiments, an alternative bracket 16*a* may be provided as seen in FIGS. 3C and 3D which comprises a plurality of plates 37 coupled to the back surface 36 of the bracket 16*a*. Each of the plurality of plates 37 extend in a substantially perpendicular direction relative to the back surface 36 and are configured to placed flush against the surface of the wall 1. In certain embodiments, each of the plurality of plates 37 comprises a hole or aperture 39 defined therein so that the bracket 16*a* may be coupled directly to the wall 1 via a corresponding plurality of nails, screws, or other fasteners known in the art. For example, as illustrated in FIG. 3E, a plurality of brackets 16*a* are coupled to the wall 1 with their corresponding plates 37 disposed over at least one stud 3 shown in broken line outline, each stud 3 being embedded or disposed behind the surface of the wall 1. A nail, screw, or other mechanical coupling means now known or later devised is then threaded through or inserted in the hole or aperture 39 defined in each plate 37 so as penetrate through the wall 1 and into the stud 3, thereby forming a secure connection therein. With multiple brackets 16*a* coupled to the studs 3 of wall 1, a frame 18 or other shelving unit is coupled to the brackets 16*a* as detailed further below. In a related embodiment, a wall anchor may be used in conjunction with the nail, screw, or other mechanical coupling means when the brackets 16*a* are not disposed over any studs 3 or for when no studs 3 are available. According to certain embodiments, the bracket 16*a* is coupled to the wall 1 by applying an adhesive, glue, or other material to a back surface of the plates 37 and then pressing the plates 37 against the surface of the wall 1. By being coupled directly to the wall 1 via the plates 37, the bracket 16*a* negates the need for the user to first install the track 12 and one or more uprights 14 as described above.

Returning to FIGS. 1A-1C, the frame 18 comprises a parallel pair of longitudinal edges 50 and a parallel pair of lateral edges 52 that are coupled to each to other via a plurality of joints 54 to form a substantially rectangle shape. The pair of longitudinal edges 50 and the pair of lateral edges 52 cooperate to provide a platform for a number of different accessories or items to be placed thereon. For example, in certain embodiments, one or more shelf plates 56 may be disposed across the edges 50, 52 so as to provide a flat or horizontal shelf space for storing goods, dishware, or other items thereon. Each of the plurality of joints 54 comprise an internal volume which is configured to be removably coupled to at least one of the pins 48, 48' disposed on the bracket 16.

As also seen in FIGS. 1A-1C, in certain embodiments the pegboard 20 is removably coupled to at least one upright 14. The pegboard 20 comprises a body 58 which comprises a plurality of holes 60 defined therethrough, each of the plurality of holes 60 being configured to accommodate a peg, hook, or other coupling means for an appliance, dish rack, hanging basket or other container to be inserted therein and rest or hang against the body 58 of the pegboard 20. The pegboard 20 further comprises a plurality of hook apertures 62 defined through the body 58 and near its lateral edges as best seen in FIG. 1C. Each hook aperture 62 comprises an elongated or extended shape and is configured to accommodate at least one of the hooks 26 of an upright 14. In certain embodiments, the hook apertures 62 are defined along the lateral edges of the body 58 in a paired configuration so as to provide two hook apertures 62 disposed side by side along each vertical lateral edge of the body 58. In certain embodiments, the pegboard 20 is comprised of acrylonitrile butadiene styrene (ABS), however in other embodiments other thermoplastic polymers, plastics, wood, cork, cardboard, or other suitable materials may be used without departing from the original scope of the current invention.

Figure 4A:
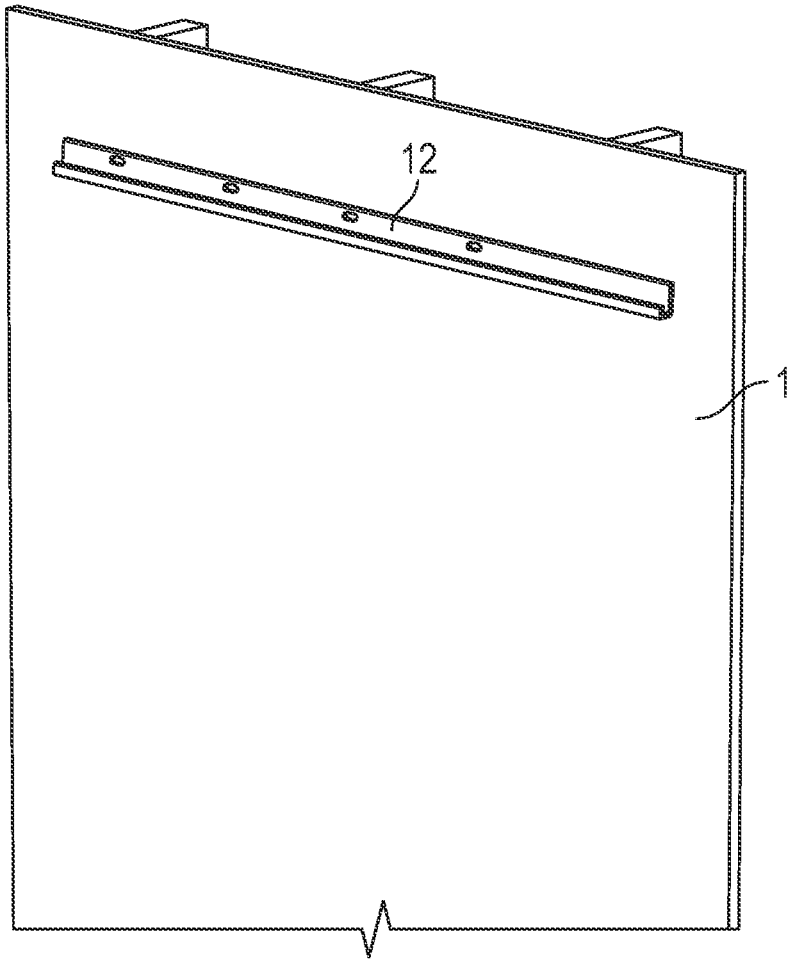
FIG. 4A is a perspective view of a track used in the shelving system of FIG. 1A after being coupled to a wall.
Figure 4B:
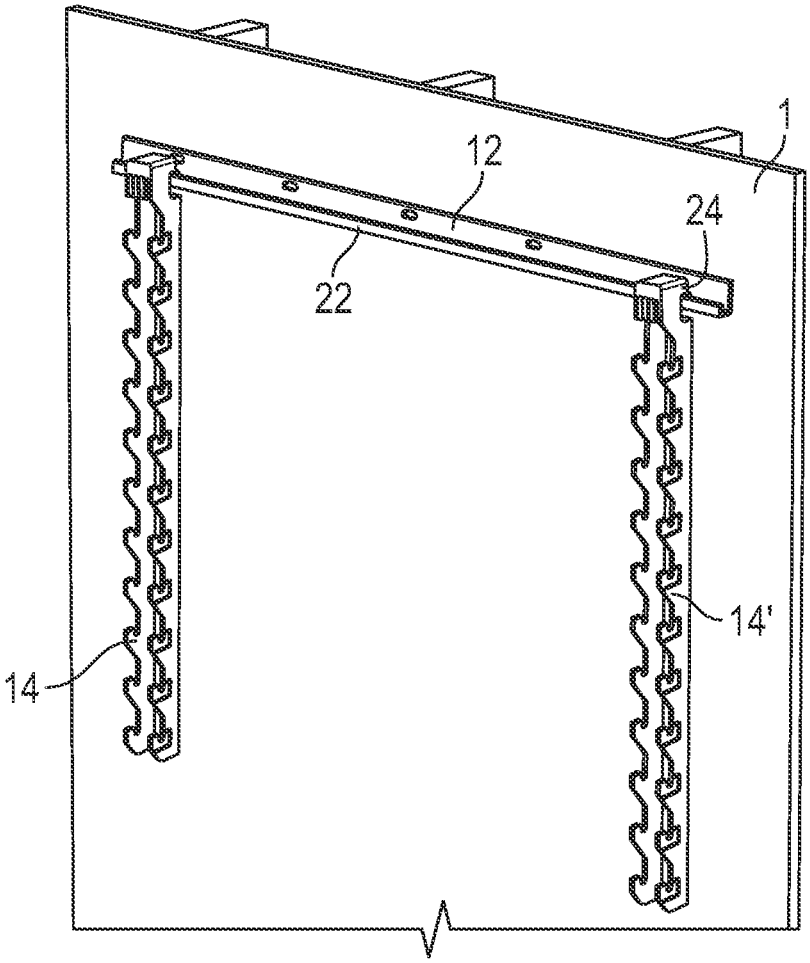
FIG. 4B is a perspective view of the track of FIG. 4A after a pair of uprights have been coupled to the track.
Figure 4C:
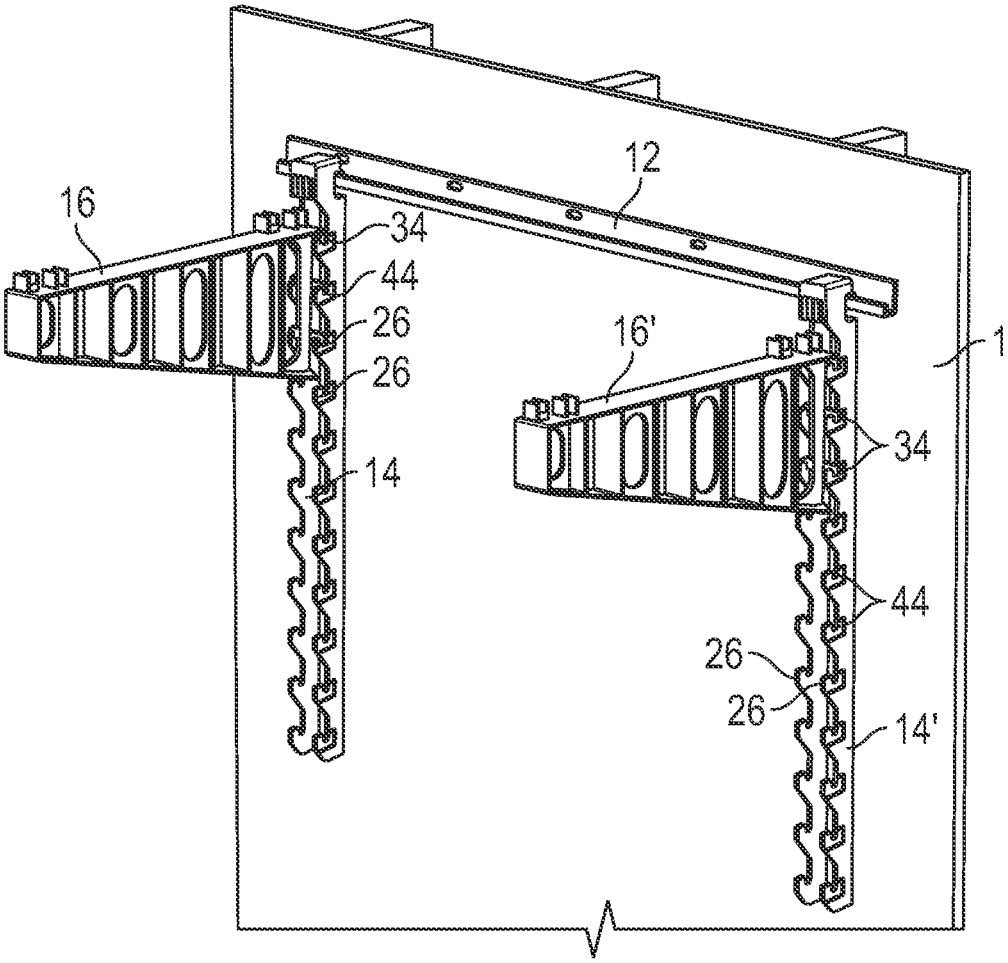
FIG. 4C is a perspective view following FIG. 4B after a bracket has been coupled to each of the uprights.
Figure 4D:
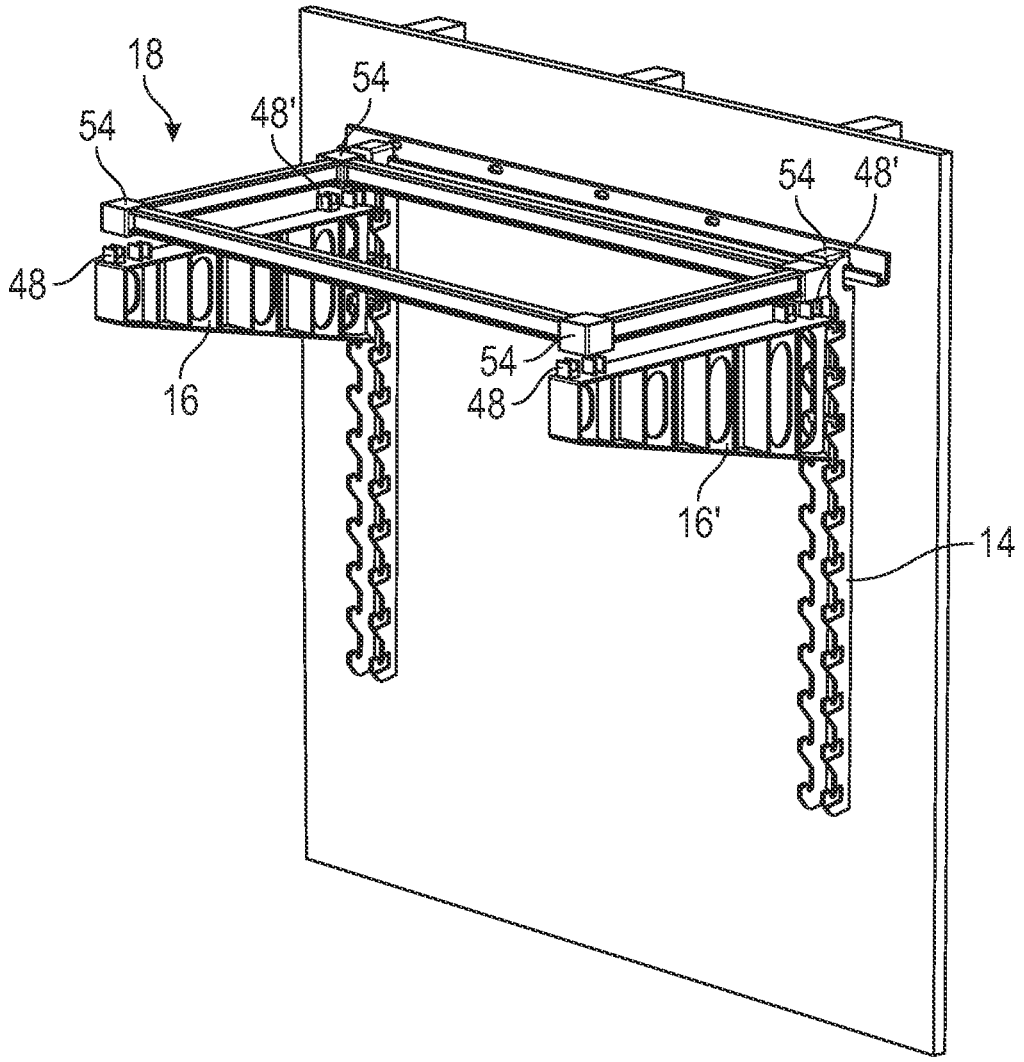
FIG. 4D is a perspective view following FIG. 4C after a frame has been disposed over the pair of brackets, the joints of the frame being disposed over the pins of each of the brackets.
Figure 4E:
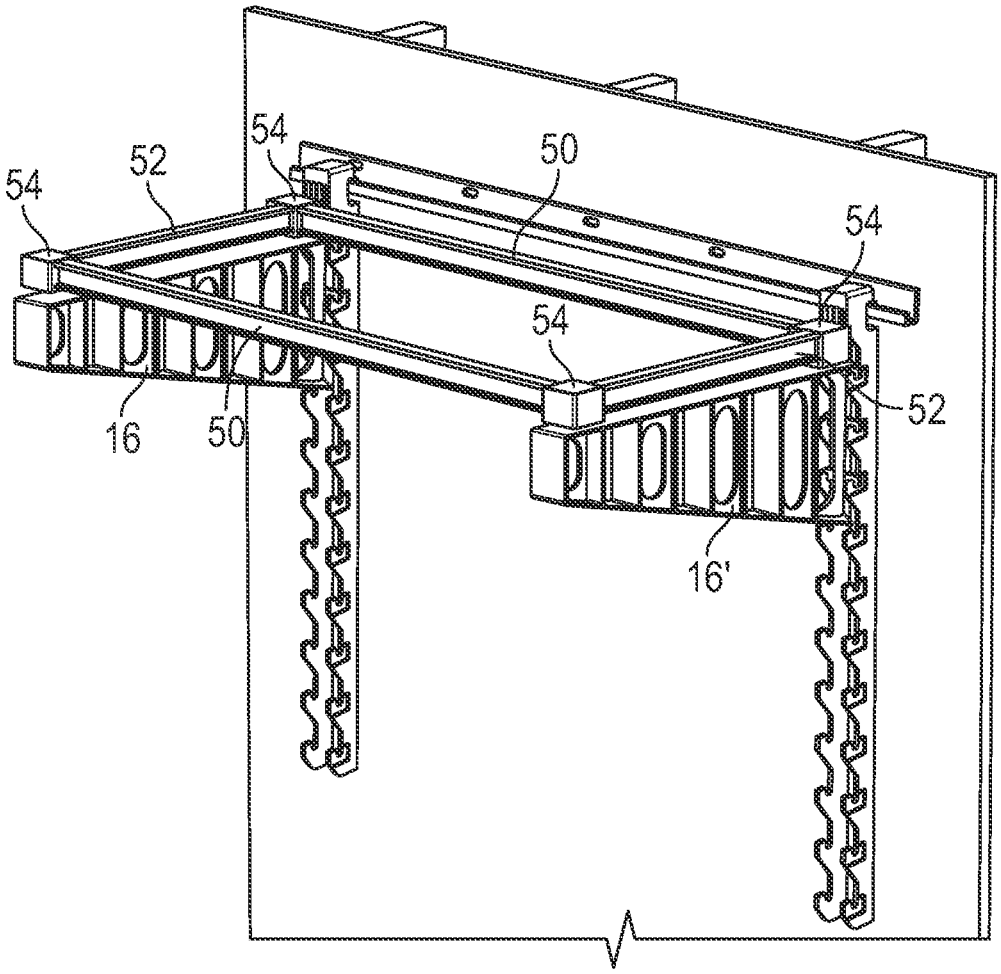
FIG. 4E is a perspective view following FIG. 4D after the frame has been coupled to the pair of brackets, the joints of the frame encompassing the pins of each of the brackets.
Figure 4F:
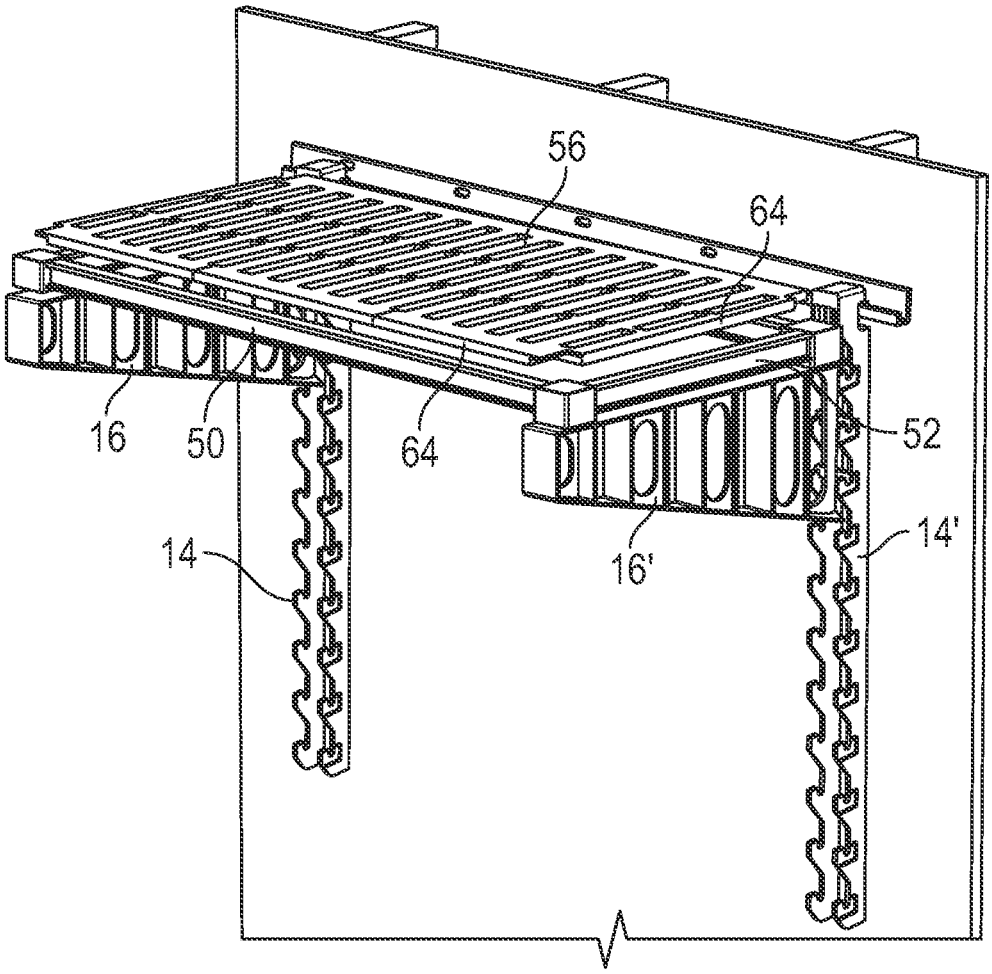
FIG. 4F is a perspective view following FIG. 4E after a plurality of shelf plates have been disposed over the frame.
Figure 4G:
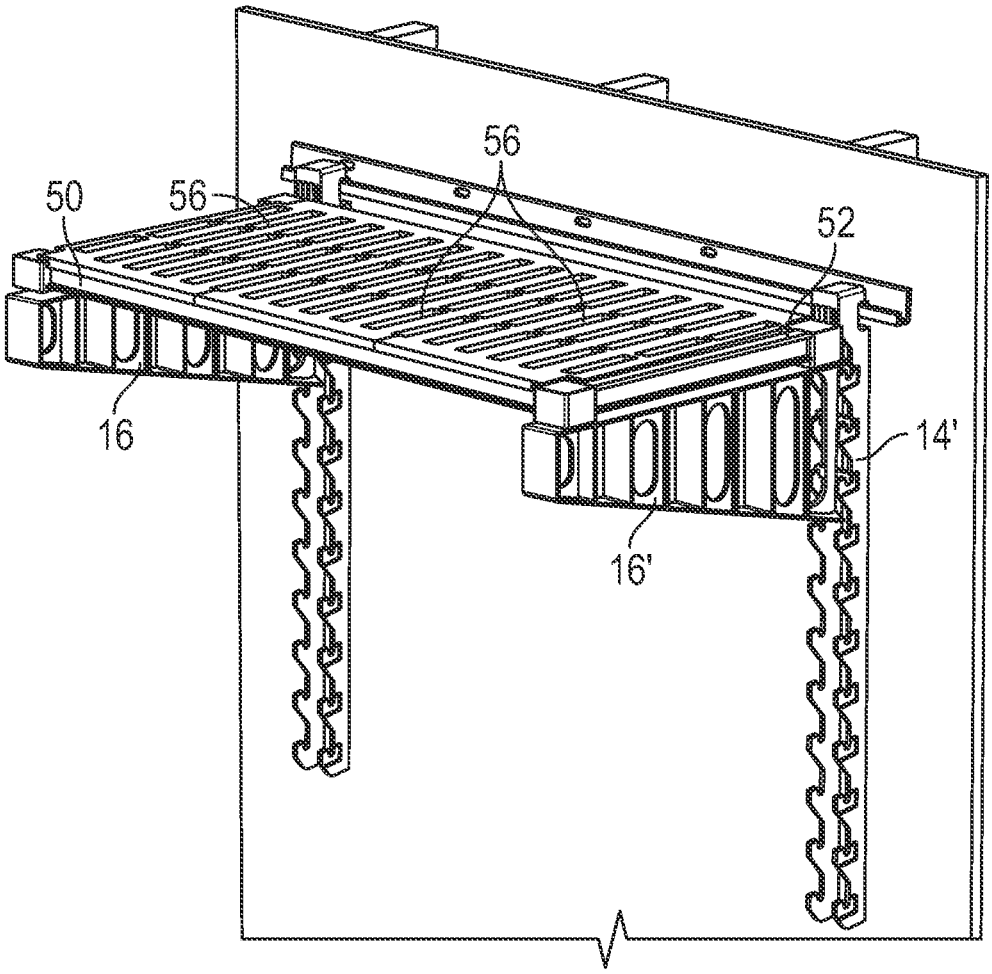
FIG. 4G is a perspective view following FIG. 4F after the plurality of shelf plates have been coupled to the frame.

Greater detail of how the shelving system 10 is affixed to a wall 1 or other stationary object may be seen in FIGS. 4A-4I. To install the shelving system 10 to a wall 1, the track 12 is first coupled to the wall 1 as seen in FIG. 4A. The track 12 is preferably coupled to the wall 1 by a plurality of screws, nails, or the like, however in certain embodiments an adhesive or glue may be used. Next, as seen in FIG. 4B, a plurality of uprights 14, 14' are disposed or hung onto the track 12. In certain embodiments, each upright 14, 14' is hung on the track 12 by disposing the catch 24 of the upright 14, 14' over the upturned edge 22 of the track 12. The upright is then released, leaving the upright 14, 14' to rest against the wall 1. A corresponding bracket 16, 16' is then coupled to each upright 14 as seen in FIG. 4C, for example a first bracket 16 being coupled to a first upright 14, and a second bracket 16' being coupled to a second upright 14'. In certain embodiments, after determining the relative vertical position along the height of the upright 14 the bracket 16 is to be placed, each of the plurality of flanges 34 disposed on the bracket 16 are inserted into a corresponding plurality of grooves 44. The bracket 16 is then pushed in a downward direction or parallel to the surface of the wall 1 so that each flange 36 is tightly fitted or nested within its corresponding groove 44. In certain embodiments as seen in FIG. 4C, a second bracket 16' is coupled to a second upright 14 at the same relative vertical height as the first bracket 16 so as to provide a pair of parallel brackets 16 projected outward from the wall 1. Next, according to certain embodiments, the frame 18 is coupled to the brackets 16, 16' by first aligning the plurality of joints 54 with the proximal pins 48 and the distal pins 48' of each of the brackets 16, 16', respectively, as seen in FIG. 4D. Once aligned, the frame 18 is placed downward onto the corresponding brackets 16, 16', specifically with the proximal pins 48 and the distal pins 48' being inserted into the corresponding internal volumes of each joint 54 as shown in FIG. 4E. The joints 54 are configured to interact or engage with the pins 48, 48' via a friction or snap fit so that the frame 18 may be optionally removed from the brackets 16, 16', however in other embodiments, the joints 54 are coupled to the brackets 16, 16' using an adhesive, weld, or other coupling means such as nuts, bolts, nails, or the like. With the frame 18 coupled to the brackets 16, 16', the longitudinal edges 50 and lateral edges 52 provide a support structure for a variety of user determined accessories or attachments to be coupled thereto. For example, as seen in FIG. 4F, a plurality of shelf plates 56 are coupled to the frame 18, specifically, with an overhanging edge or lip 64 or plurality of overhanging edges or lips 64 being disposed over the corresponding upward facing surfaces of the longitudinal edges 50 and the lateral edges 52. The user then inserts the shelf plates 56 into the frame 18 as seen in FIG. 4G with the overhanging edges or lips 64 fitting over the corresponding edges 50, 52. Goods or other items may then be placed on the shelf plates 56 of the shelf system 10. In certain embodiments, the shelf plates 56 are coupled to the longitudinal edges 50 and/or the lateral edges 52 via a friction fit or snap fit, however in other embodiments, each shelf plate 56 is coupled to the longitudinal edges 50 and/or the lateral edges 52 using an adhesive or other suitable mechanical means. FIGS. 4F and 4G show a plurality of shelf plates 56 being removably coupled to the frame 18, however in certain other embodiments only one shelf plate 56 may be coupled to the frame 18 at any longitudinal position along the longitudinal edges 50.

Figure 4H:
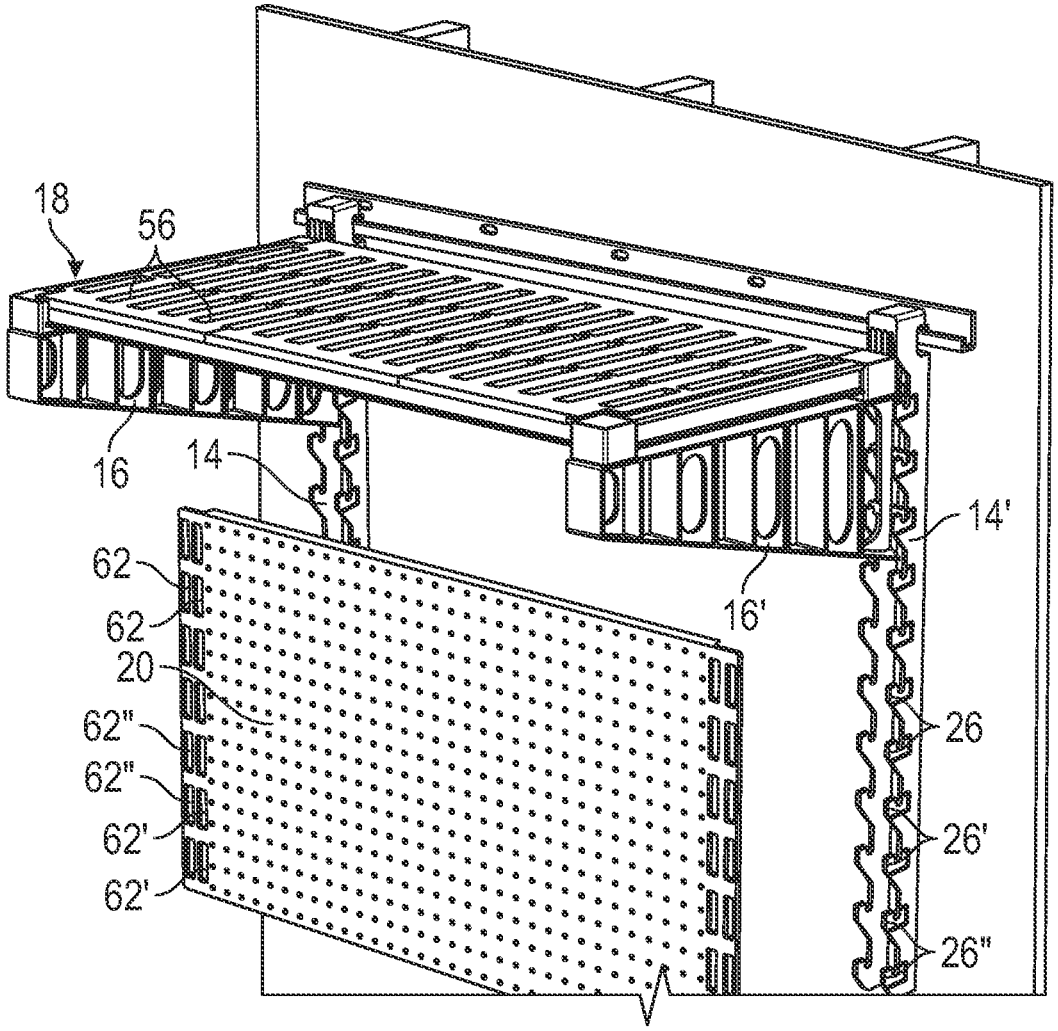
FIG. 4H is a perspective view following FIG. 4G after a pegboard has been placed into close proximity of the plurality of uprights.
Figure 4I:
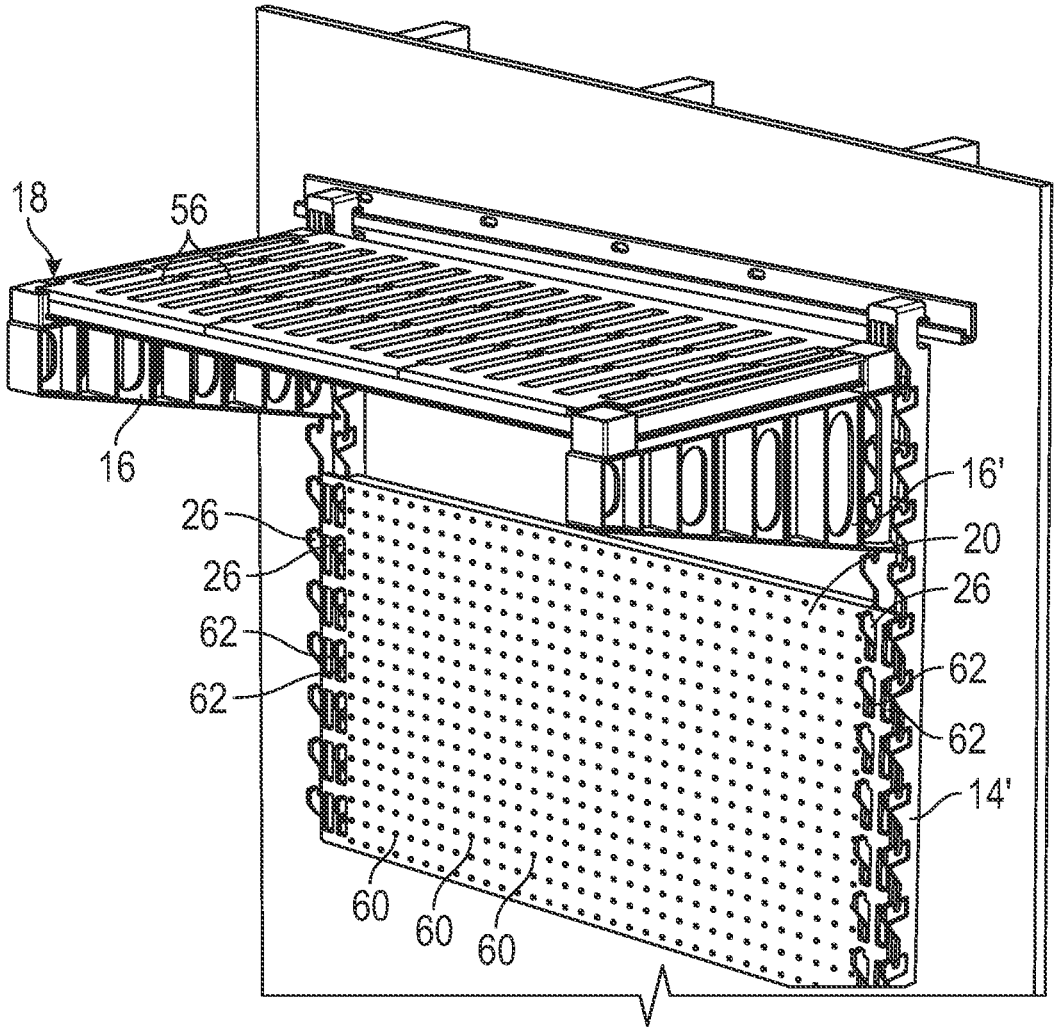
FIG. 4I is a perspective view following FIG. 4H after the pegboard has been coupled to the plurality of uprights, specifically with a plurality of hooks disposed on each of the uprights being inserted through a corresponding plurality of hook apertures defined in the pegboard.

Turning to FIGS. 4H and 4I, the pegboard 20 is incorporated into the shelving system 10 by removably coupling the pegboard 20 to at least one of the uprights 14. Specifically, the user disposes the pegboard 20 at the desired vertical height relative to the upright 14 by aligning at least one of the hook apertures 62 defined therein with a corresponding hook 26 disposed on the upright 14 and then inserting the hook 26 therein. As discussed above, both the plurality of hook apertures 62 and the plurality of hooks 26 are disposed so as to form a series of vertical pairs, with each upright 14 comprising a series of vertical pairs of hooks 26, namely with each pair being formed by an inside hook 26' and an outside hook 26", and with the pegboard 20 comprising a series of vertical pairs of hook apertures 62 on either lateral end of the pegboard 20, namely with each pair being formed by an inside hook aperture 62' and an outside hook aperture 62". When the user is coupling the pegboard 20 to the upright 14, the user inserts a plurality of hooks 26 of the upright 14 through a corresponding plurality of hook apertures 62. In certain embodiments, a plurality of inside hooks 26' are inserted into a corresponding plurality of inside hook apertures 62' which leave the outside hook apertures 62" of the pegboard 20 empty or vacant and the outside hooks 26" of the upright 14 open or otherwise available. In certain other embodiments, all the hook apertures 62 of the pegboard 20 may be engaged with the hooks 26 of the upright 14, for example the plurality of inside hooks 26' are inserted into a corresponding plurality of inside hook apertures 62' while the plurality of outside hooks 26" are inserted into a corresponding plurality of outside hook apertures 62". While FIGS. 4H and 4I show the pegboard 20 coupled to the uprights 14 at a vertical position that is beneath the brackets 16 and the frame 18, it is to be expressly understood that in certain embodiments the pegboard 20 is coupled to the uprights 14 at position that is above the brackets 16 and the frame 18.

Figure 5:
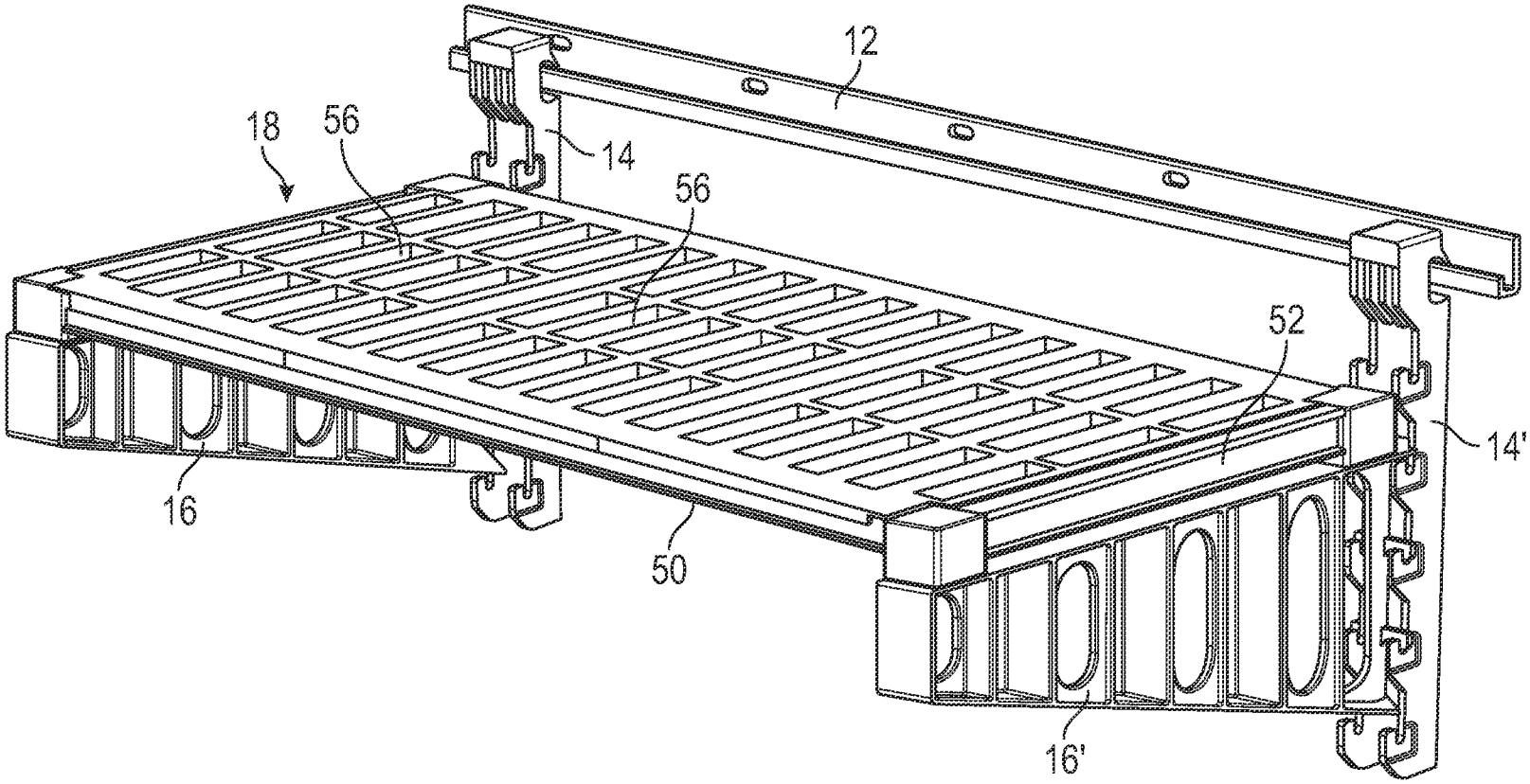
FIG. 5 is a perspective view of an alternative embodiment of the shelving system of the current invention comprising a frame coupled to a pair of brackets that are in turn coupled to a pair of uprights.

In still further embodiments, the pegboard 20 may be coupled to the uprights 14, 14' without the brackets 16, 16' and the frame 18, or alternatively, the brackets 16, 16' and frame 18 may be coupled to the brackets 16, 16' without the pegboard 20. For example, FIG. 5 shows an alternative embodiment of the shelving system 110 comprising a pair of brackets 16 coupled to a corresponding pair of uprights 14 that are coupled to a track 12. In this embodiment, the uprights 14 comprise a shortened or otherwise smaller height over what is seen in FIGS. 1A-2B so as to accommodate only the brackets 16 and no other accessories or components such as the pegboard 20.

Figure 6:
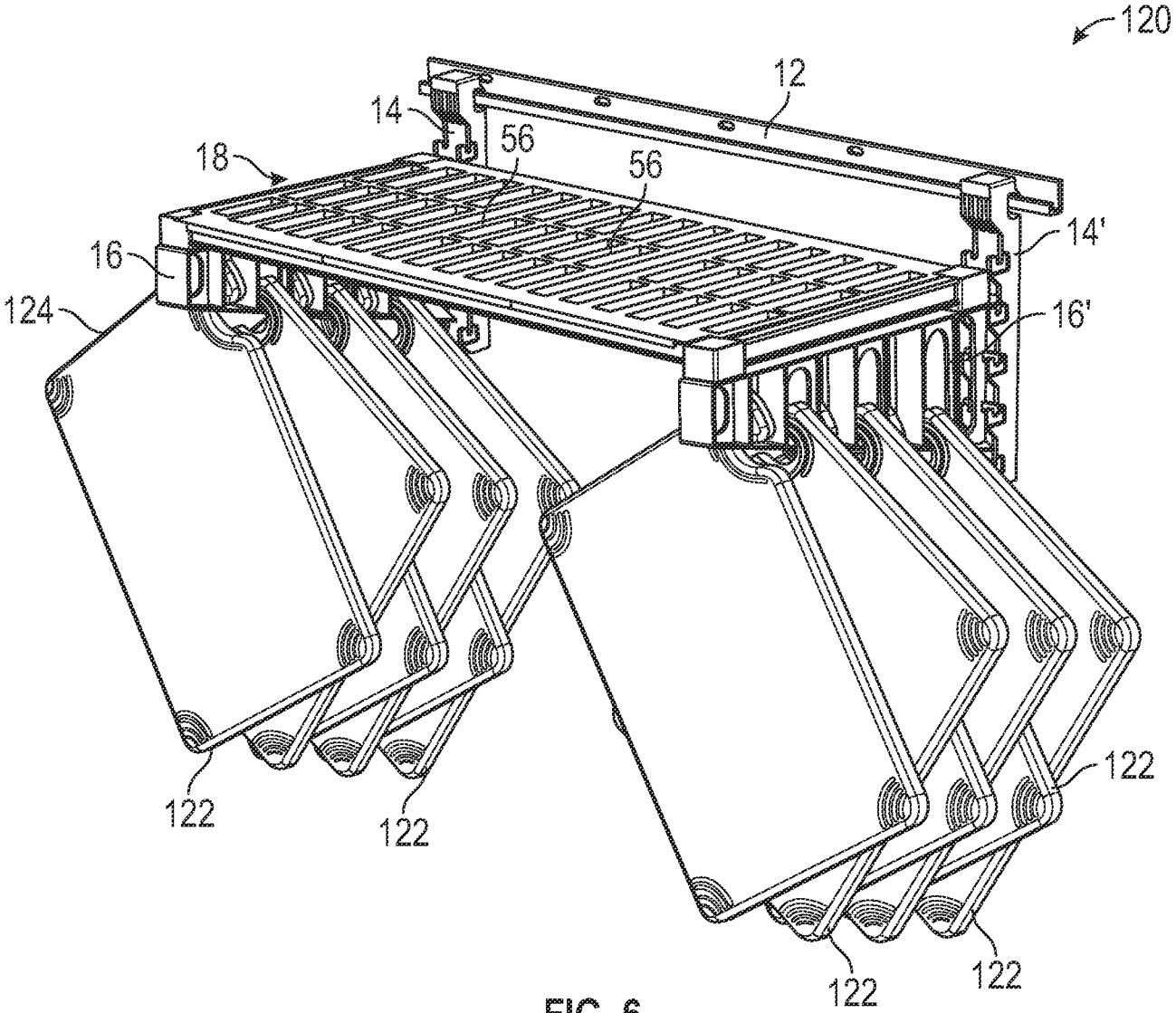
FIG. 6 is a perspective view of an alternative embodiment of the shelving system of the current invention comprising a plurality of cutting boards removably coupled to the brackets.

In an alternative embodiment seen in FIG. 6, an alternate shelving system 120 comprises a plurality of cutting boards 122 that are removably coupled or hung from the brackets 16. In this embodiment, after the user has coupled the brackets 16, 16' to the uprights 14, 14' as described above, one or more cutting boards 122 comprising a cutting board hook 124 is coupled to at least one of the brackets 16 by disposing the cutting board hook 124 on or through the body 46 of the bracket 16, allowing the cutting board 122 to hang therefrom. Additional cutting boards 122 may then be coupled to each bracket 16, specifically along the length of the bottom surface 30 so as to provide easy access for the user. Each cutting board 122 is comprised of washable plastic or plastic composites, however alternative materials such as wood, bamboo, or rubber may also be used.

Figure 7:
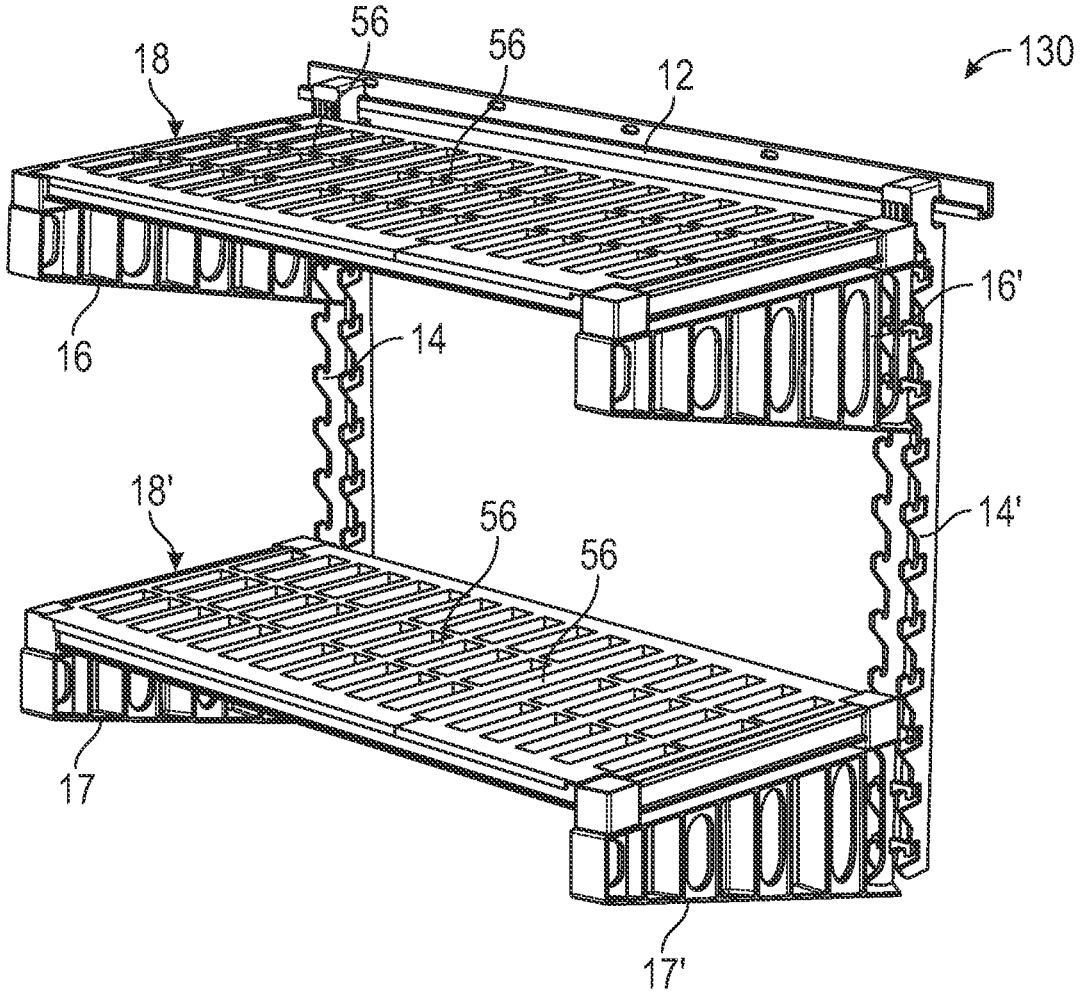
FIG. 7 is a perspective view of an alternative embodiment of the shelving system of the current invention comprising two frames, each one of the frames coupled to a pair of brackets that are in turn coupled to a pair of uprights.

FIG. 7 shows an alternative shelving system 130 comprising a first pair of brackets 16, 16' and a second pair of brackets 17, 17' coupled to same pair of uprights 14 14'. Both the first pair of brackets 16, 16' and the second pair of brackets 17, 17' are coupled to the uprights 14 in same manner shown in FIGS. 4A-4I and as described above. After the brackets 16, 16', 17, 17' are coupled to the uprights 14, 14', a first frame 18 and a second frame 18' are in turn coupled to the first pair of brackets 16, 16' and the second pair of brackets 17, 17', respectively. In certain embodiments, the first and second frames 18, 18' are identical to each other and are coupled to the respective brackets 16, 16', 17, 17' in the same manner shown and described in FIGS. 4A-4I. As seen in FIG. 7, a plurality of shelf plates 56 are then coupled to both the first and second frames 18, 18', however in other embodiments, fewer or additional shelf plates may be inserted into each respective frame 18, 18'.

Figure 8:
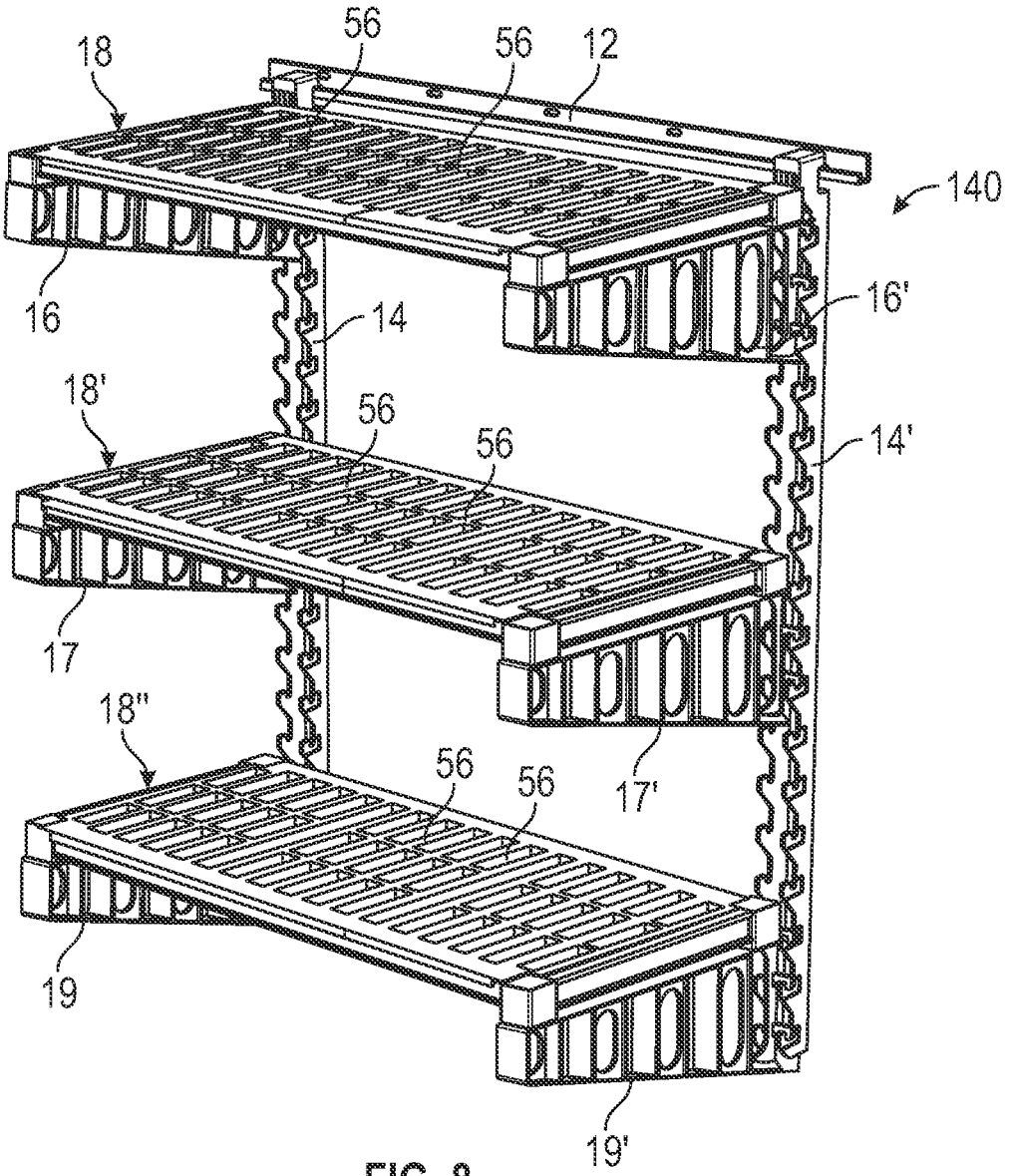
FIG. 8 is a perspective view of an alternative embodiment of the shelving system of the current invention comprising three frames, each one of the frames coupled to a pair of brackets that are in turn coupled to a pair of uprights.

FIG. 8 shows an alternative shelving system 140 comprising a first pair of brackets 16, 16', a second pair of brackets 17, 17', and a third pair of brackets 19, 19' coupled to same or single pair of uprights 14, 14'. Each bracket 16, 16', 17, 17', 19, 19' is coupled to the uprights 14, 14' in same manner shown in FIGS. 4A-4I and as described above. After each bracket 16, 16', 17, 17', 19, 19' is coupled to the uprights 14, 14' a first frame 18, a second frame 18', and a third frame 18" are in turn coupled to the first pair of brackets 16, 16', the second pair of brackets 17, 17', and the third pair of brackets 19, 19', respectively. In certain embodiments, the first, second, and third frames 18, 18', 18" are identical to each other and are coupled to each respective bracket in the same manner shown and described in FIGS. 4A-4I. As seen in FIG. 8, a plurality of shelf plates 56 are then coupled to the first, second, and third frames 18, 18', 18", however in other embodiments, fewer or additional shelf plates may be inserted into each respective frame 18, 18', 18".

Figure 9:
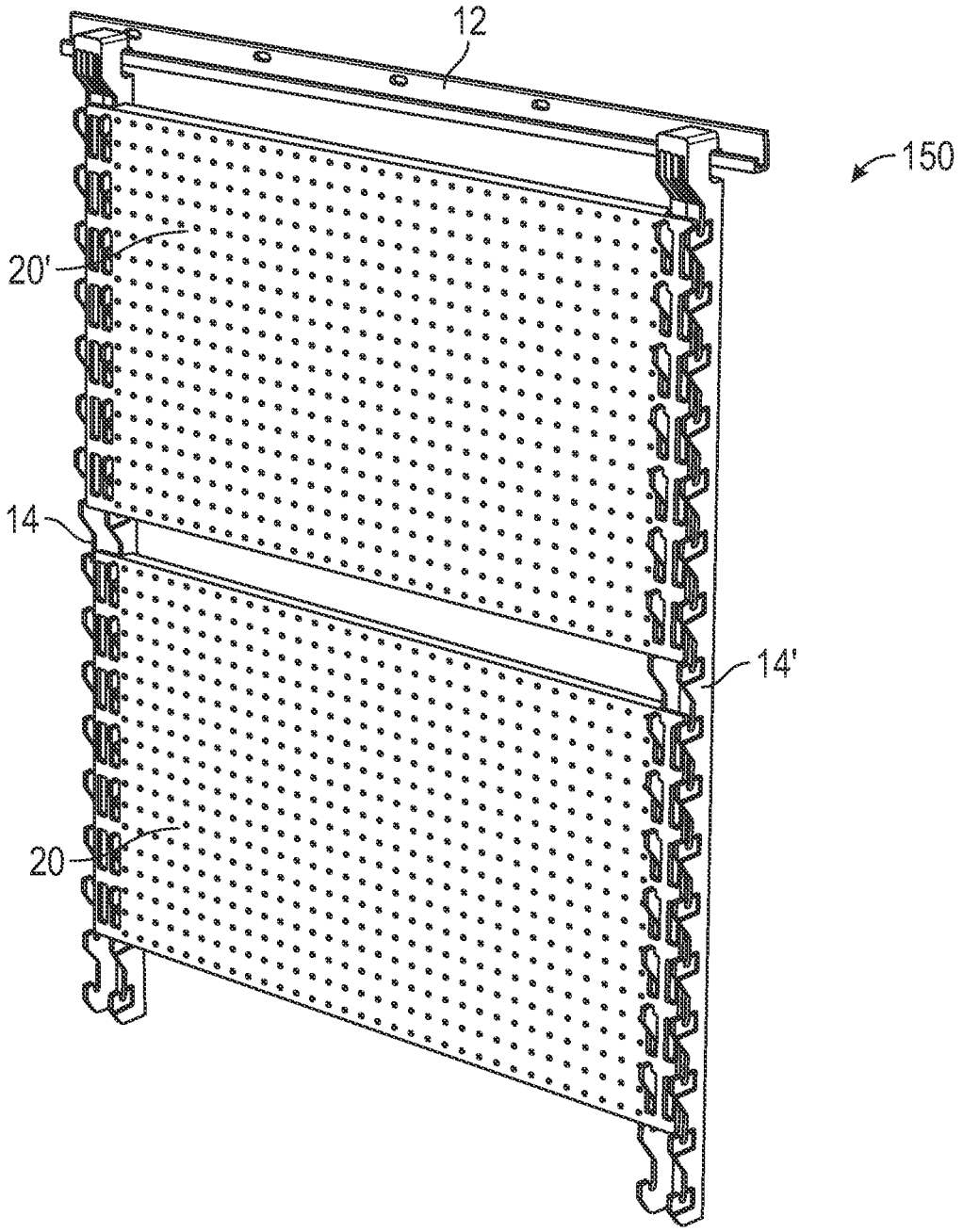
FIG. 9 is a perspective view of an alternative embodiment of the shelving system of the current invention comprising two pegboards, each one of the pegboards in turn coupled to a pair of uprights.

FIG. 9 shows an alternative shelving system 150 comprising a first pegboard 20 and a second pegboard 20' coupled to same or single pair of uprights 14, 14' disposed or hanging on a track 12. Each of the pegboards 20, 20' is coupled to the uprights 14 in same manner shown in FIGS. 4H and 4I and as described above. In certain embodiments, fewer or additional pegboards 20 other than what is explicitly shown may be coupled to the uprights 14 as desired.

Figure 10:
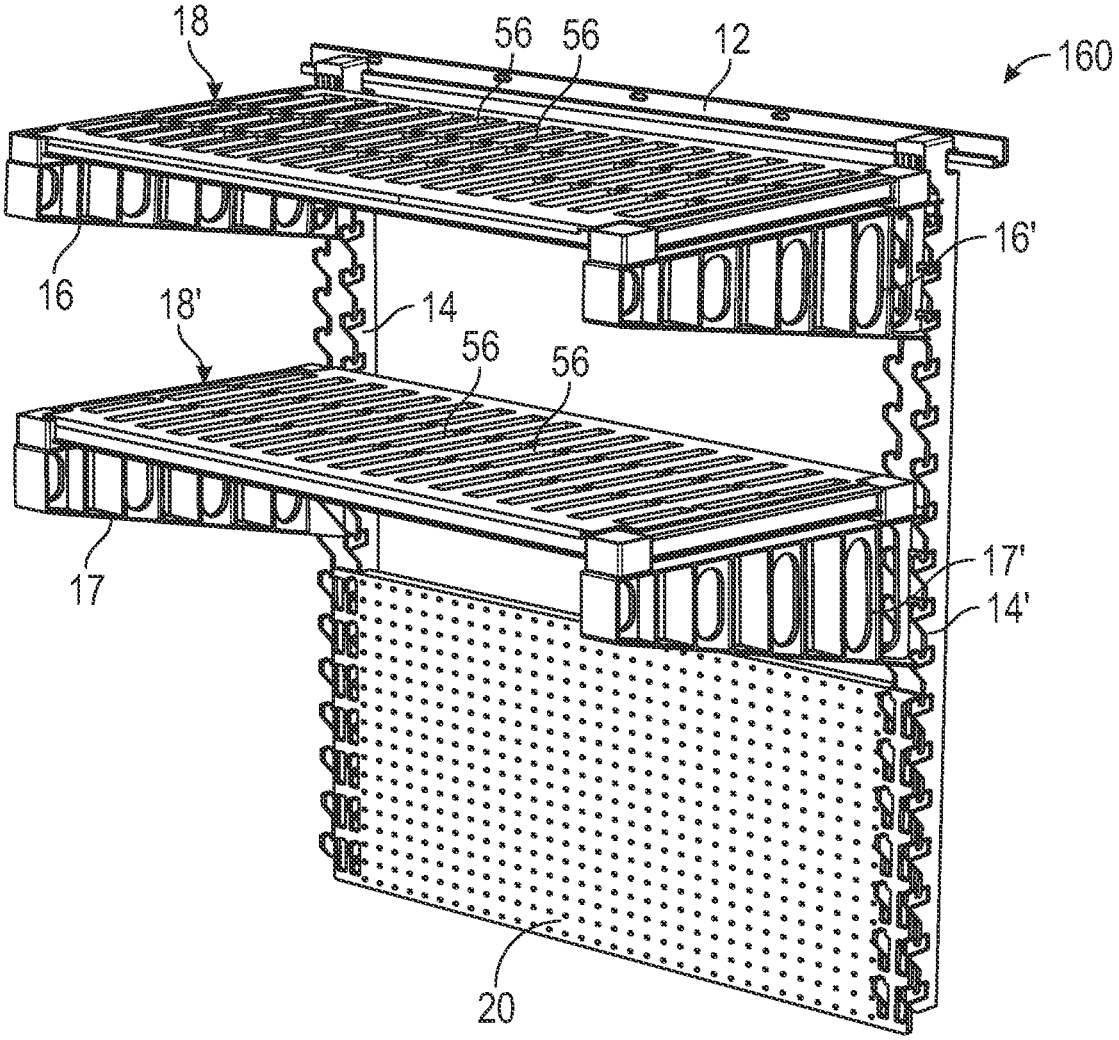
FIG. 10 is a perspective view of an alternative embodiment of the shelving system of the current invention comprising two frames and a pegboard, each one of the frames and the pegboard being coupled to a pair of brackets that are in turn coupled to a pair of uprights.

FIG. 10 shows an alternative shelving system 160 comprising a first pair of brackets 16, 16' and a second pair of brackets 17, 17' coupled to same pair of uprights 14, 14'. Each bracket 16, 16', 17, 17' is coupled to the uprights 14, 14' in same manner shown in FIGS. 4A-4I and as described above. After each bracket 16, 16', 17, 17' is coupled to the uprights 14, 14', a first frame 18 and a second frame 18' are in turn coupled to the first pair of brackets 16, 16' and the second pair of brackets 17, 17', respectively. In certain embodiments, the first and second frames 18, 18' are identical to each other and are coupled to the respective brackets 16, 16', 17, 17' in the same manner shown and described in FIGS. 4A-4I. A plurality of shelf plates 56 are then coupled to both the first and second frames 18, 18', however in other embodiments, fewer or additional shelf plates may be inserted into each respective frame 18, 18'. FIG. 10 further shows a pegboard 20 which is coupled to the same pair of uprights 14, 14' as the brackets 16, 16', 17, 17'. The pegboard 20 is coupled to the uprights 14, 14' in same manner shown in FIGS. 4H and 4I and as described above. While FIG. 10 shows two frames 18, 18' and their respective brackets 16, 16', 17, 17' being coupled to the uprights 14, 14' in a position that is above or higher relative to the pegboard 20, it should be explicitly understood that the brackets 16, 16', 17, 17' and the pegboard 20 may be disposed along the height of the uprights 14,14' in any order without departing from the original spirit and scope of the invention.

Figure 11:
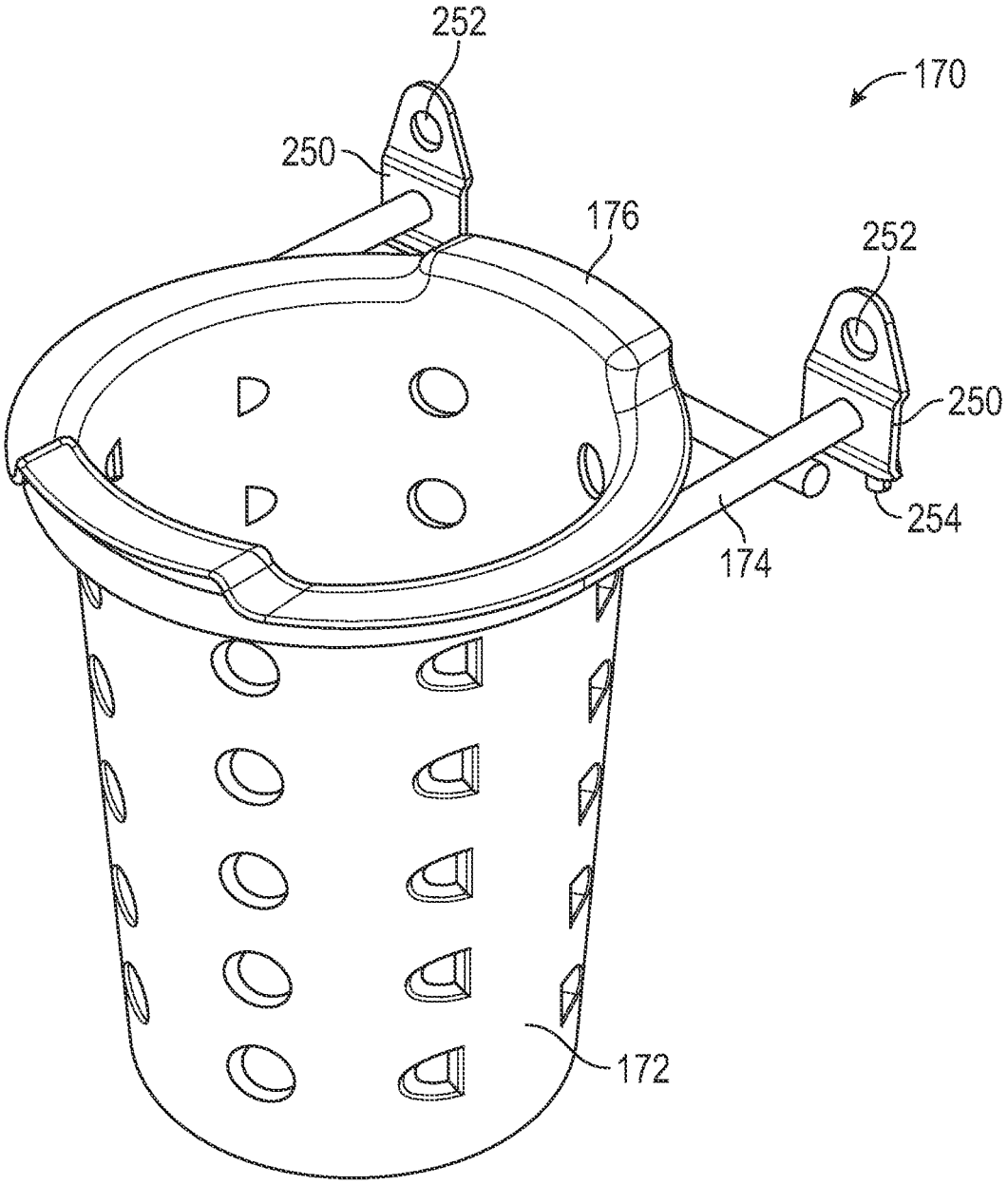
FIG. 11 is a perspective view of a cup unit comprising a cup, the cup unit being configured to be coupled to the pegboard of the shelving system of FIG. 1A.

FIGS. 11-14 show a plurality of different modular or attachment units that are removably coupled to the pegboard 20 according to certain aspects of the invention. FIG. 11 shows a cup attachment unit 170 comprising a cup or other substantially cylindrical shaped carrier 172 and a wire frame 174. The cup 172 comprises a substantially circular rim or lip 176 which, when the cup 172 is inserted into the wire frame 174, rests upon the wire frame 174 itself. The cup attachment unit 170 further comprises a plurality of reversible attachments 250 that are removably coupled at different portions of the wire frame 174. In certain embodiments, each of the reversible attachments 250 comprises an eye 252 disposed at one end and a tab 254 disposed on an opposing end. Each attachment 250 is coupled to the wire frame 174 by having an end or portion of the wire frame 174 being inserted therethrough, however in certain embodiments each attachment 250 is coupled to the wire frame 174 by threaded engagement, magnets, a snap or friction fit, or other equivalent means. To couple the cup attachment unit 170 to a pegboard 20, a pair of hooks, nails, bolts, or other equivalent means (not shown) are first inserted into two of the holes 60 defined in the pegboard 20. The attachments 250 of the cup attachment unit 170 are then aligned with the pair of hooks, nails, bolts, or other equivalent means which are then inserted through the eye 252 defined therein. In certain embodiments, the attachments 250 are rotated or are otherwise manipulated so that the tab 254 of each attachment 250 is disposed in an upward configuration. The tabs 254 are then inserted into the holes 60 defined in the pegboard 20 at the desired position. Once disposed on the pegboard 20, the cup unit 170 may hang on the pegboard 20 in static position or the user may remove the cup attachment unit 170 from its initial position or location and then recouple the cup attachment unit 170 to a secondary location on the surface of the pegboard 20.

Figure 12:
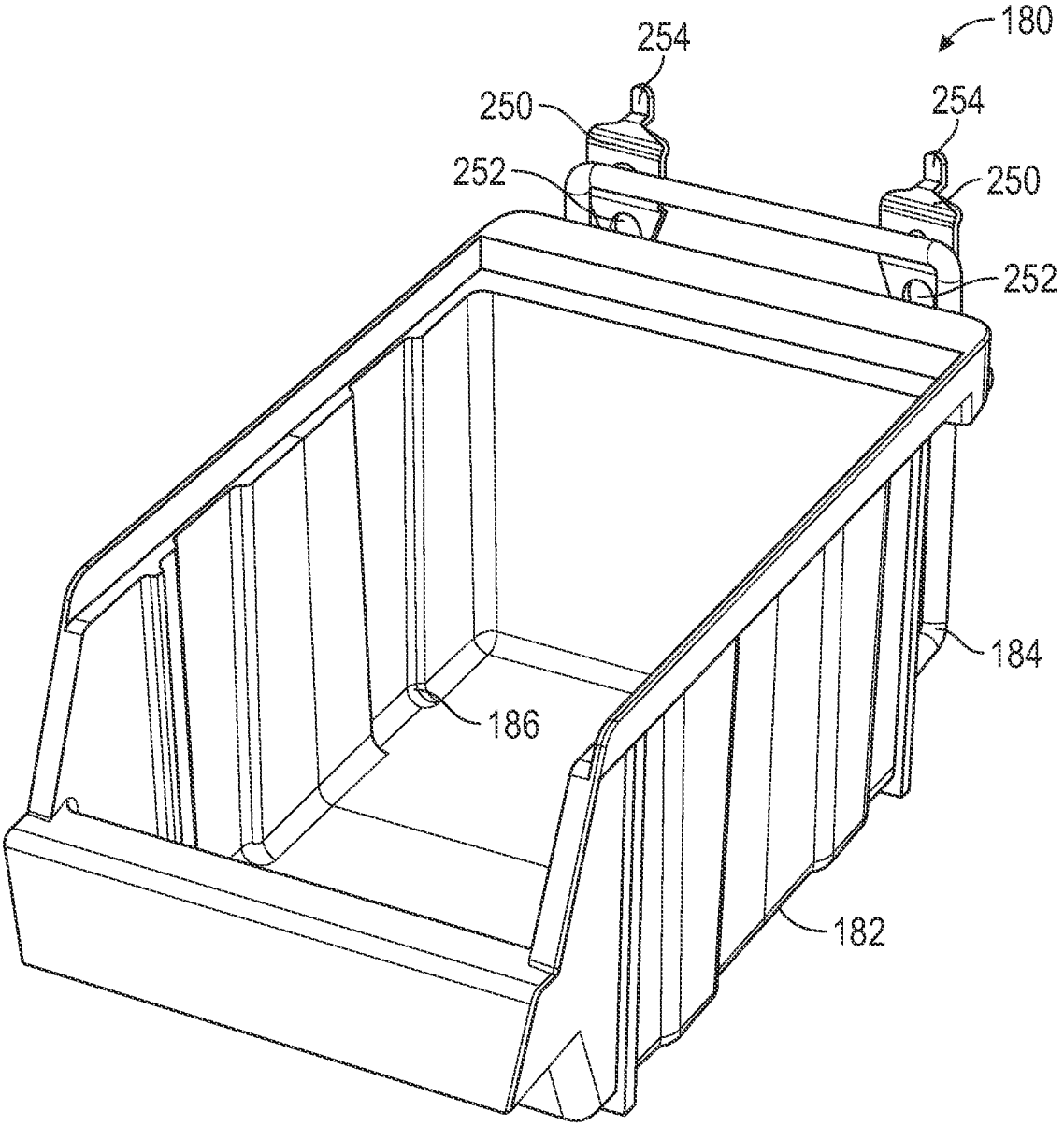
FIG. 12 is a perspective view of a basket unit comprising a carrier, the basket unit being configured to be coupled to the pegboard of the shelving system of FIG. 1A.

FIG. 12 shows a basket attachment unit 180 comprising a basket or other substantially rectangular shaped carrier 182 and a wire frame 184. In certain embodiments the basket 182 comprises an internal volume 186 configured to maintain a number of goods or items therein. The basket 182 rests upon the wire frame 184 itself. The basket attachment unit 180 further comprises a plurality of reversible attachments 250 that are removably coupled at different portions of the wire frame 184 as seen in FIG. 12. Each attachment 250 is coupled to the wire frame 184 by threaded engagement, magnets, a snap or friction fit, or other equivalent means. To couple the basket attachment unit 180 to a pegboard 20, a pair of hooks, nails, bolts, or other equivalent means (not shown) are first inserted into two of the holes 60 defined in the pegboard 20. The attachments 250 of the basket attachment unit 180 are then aligned with the pair of hooks, nails, bolts, or other equivalent means and then inserted through the eye 252 defined therein. In certain embodiments, the attachments 250 are rotated or are otherwise manipulated so that the tab 254 of each attachment 250 is disposed in an upward configuration. The tabs 254 are then inserted into the holes 60 defined in the pegboard 20 at the desired position. Once disposed on the pegboard 20, the basket attachment unit 180 may hang on the pegboard 20 in static position or the user may remove the basket attachment unit 180 from its initial position or location and then recouple the basket attachment unit 180 to a secondary location on the surface of the pegboard 20.

Figure 13:
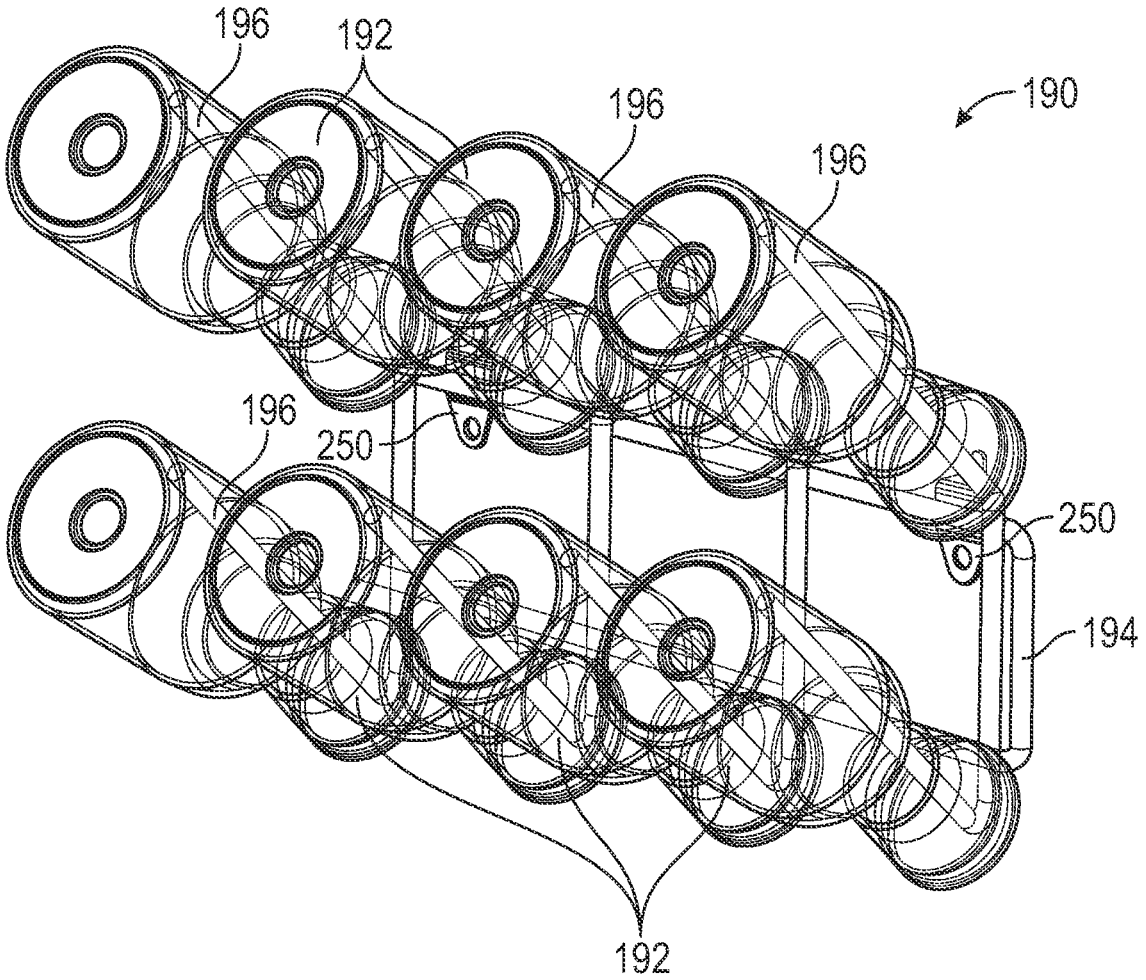
FIG. 13 is a perspective view of a drying unit comprising a wire frame, the drying unit being configured to be coupled to the pegboard of the shelving system of FIG. 1A.

FIG. 13 shows a drying attachment unit 190 comprising a wire frame 194 with a plurality of pegs 196 projecting outward therefrom. The drying attachment unit 190 further comprises a plurality of reversible attachments 250 that are removably coupled at different portions of the wire frame 194 as seen in FIG. 13. Each attachment 250 is coupled to the wire frame 194 by threaded engagement, magnets, a snap or friction fit, or other equivalent means. To couple the drying attachment unit 190 to a pegboard 20, a pair of hooks, nails, bolts, or other equivalent means (not shown) are first inserted into two of the holes 60 defined in the pegboard 20. The attachments 250 of the drying attachment unit 190 are then aligned with the pair of hooks, nails, bolts, or other equivalent means and then inserted through the eye 252 defined therein. In certain embodiments, the attachments 250 are rotated or are otherwise manipulated so that the tab 254 of each attachment 250 is disposed in an upward configuration. The tabs 254 are then inserted into the holes 60 defined in the pegboard 20 at the desired position. Once disposed on the pegboard 20, the drying attachment unit 190 may hang on the pegboard 20 in static position or the user may remove the drying attachment unit 190 from its initial position or location and then recouple the drying attachment unit 190 to a secondary location on the surface of the pegboard 20. The plurality of pegs 196 are configured to project outward at an angle relative to the vertical surface of the pegboard 20 so that a plurality of bottles 192 or other containers or items can be disposed thereon in order to air dry. Specifically, each bottle 192 or other item is placed on the wire frame 194 with at least one of the pegs 196 being inserted therein, the peg 196 providing the structural support necessary to keep the bottle 192 or other item disposed at an angle relative to the vertical surface of the pegboard 20 and/or the wall 1.

Figure 14:
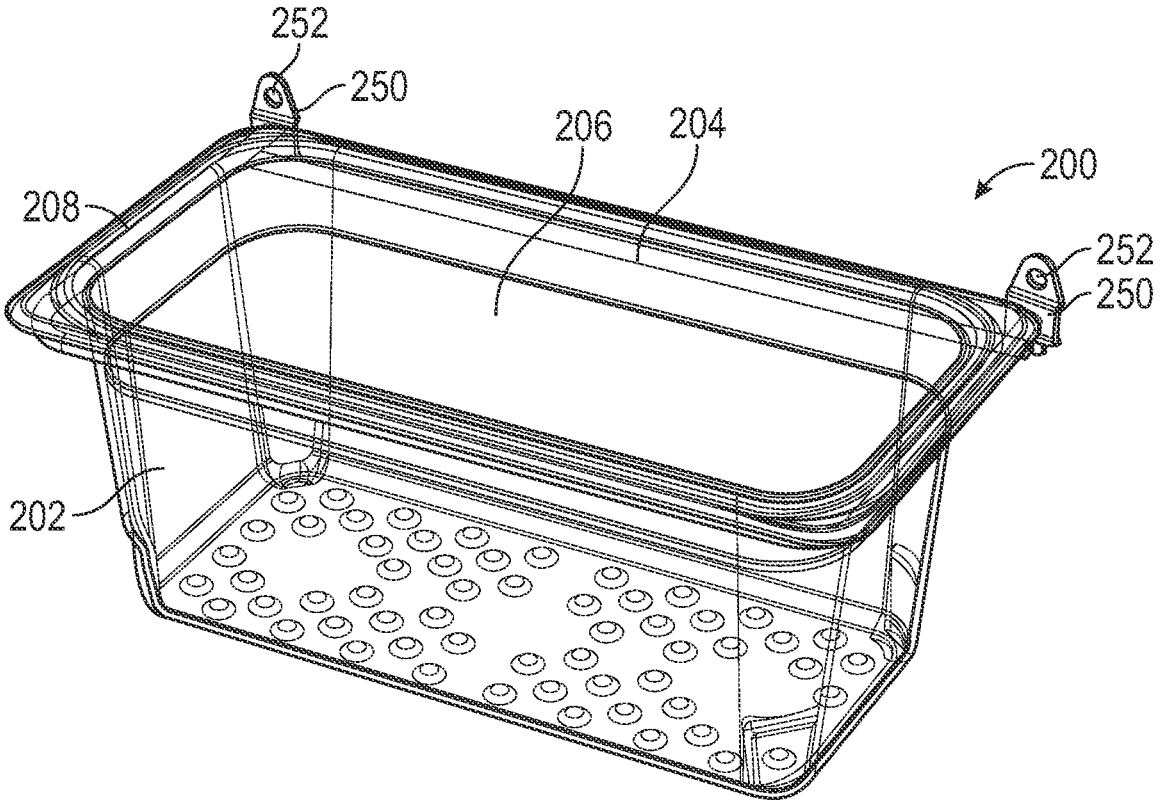
FIG. 14 is a perspective view of a container unit comprising a bin, the container unit being configured to be coupled to the pegboard of the shelving system of FIG. 1A.

FIG. 14 shows a container attachment unit 200 comprising a container or other substantially rectangular shaped bin 202 and a wire frame 204. In certain embodiments the container 202 comprises an internal volume 206 configured to maintain a number of goods or items therein. The container 202 comprises a substantially rectangular rim or lip 208 which, when the container 202 is inserted into the wire frame 204, rests upon the wire frame 204 itself. The container attachment unit 200 further comprises a plurality of reversible attachments 250 that are removably coupled at different portions of the wire frame 204 as seen in FIG. 14. Each attachment 250 is coupled to the wire frame 204 by threaded engagement, magnets, a snap or friction fit, or other equivalent means. To couple the container attachment unit 200 to a pegboard 20, a pair of hooks, nails, bolts, or other equivalent means (not shown) are first inserted into two of the holes 60 defined in the pegboard 20. The attachments 250 of the container attachment unit 200 are then aligned with the pair of hooks, nails, bolts, or other equivalent means and then inserted through the eye 252 defined therein. In certain embodiments, the attachments 250 are rotated or are otherwise manipulated so that the tab 254 of each attachment 250 is disposed in an upward configuration. The tabs 254 are then inserted into the holes 60 defined in the pegboard 20 at the desired position. Once disposed on the pegboard 20, the container attachment unit 200 may hang on the pegboard 20 in static position or the user may remove the container attachment unit 200 from its initial position or location and then recouple the container attachment unit 200 to a secondary location on the surface of the pegboard 20.

In certain embodiments, multiple attachments units 170, 180, 190, 200 may be coupled to the same pegboard 20 thereby allowing the user to fully customize the shelving system 10 according their specific needs or requirements. For example, at least one pegboard 20 within the shelving system 10 may comprise any number or combination of a cup unit 170, a basket unit 180, a drying unit 190, and/or a container unit 200 disposed thereon.

Figure 15:
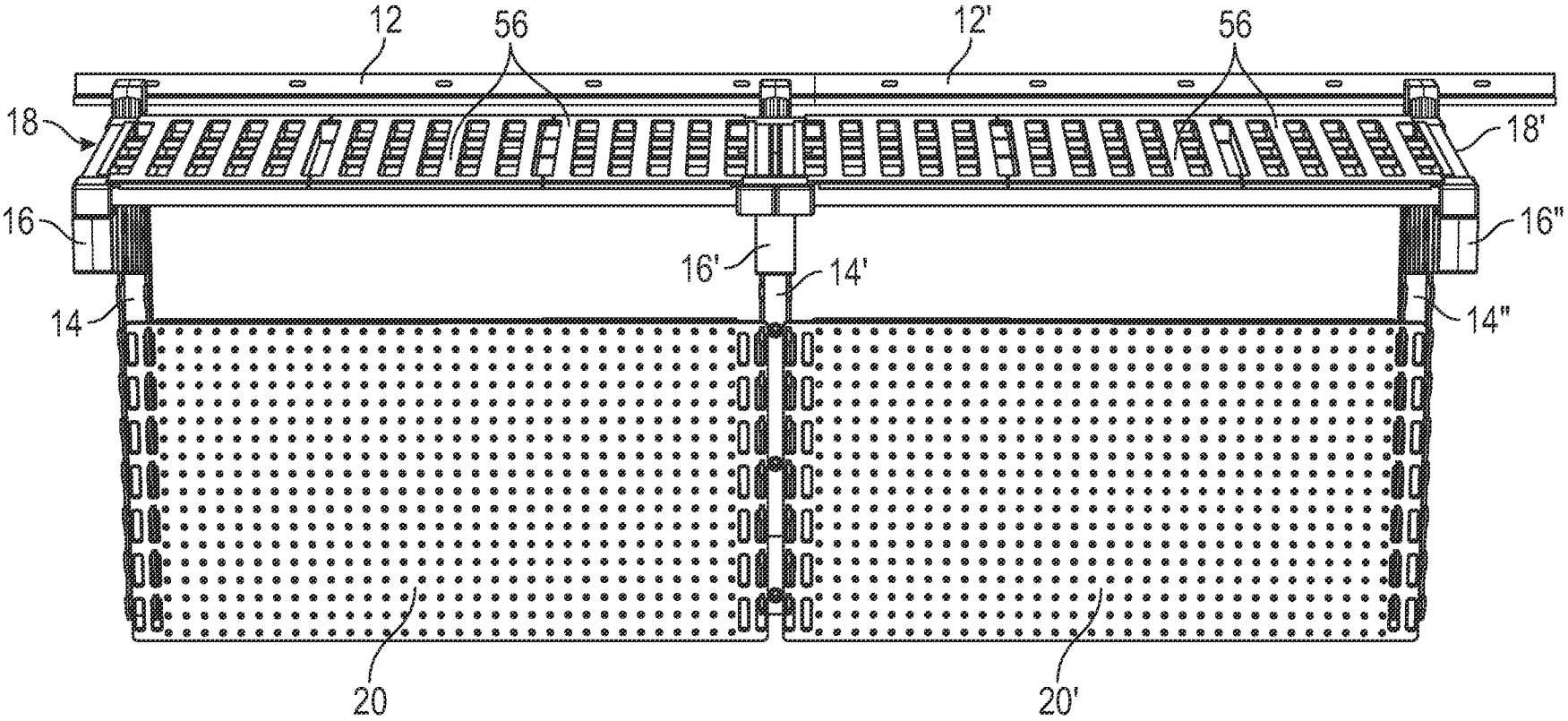
FIG. 15 is a front elevational view of an alternative embodiment of the shelving system of the current invention comprising an expanded configuration.

In certain embodiments, the shelving system 10 comprises means for providing a modular construction, thereby allowing a user to increase or expand a relative size of the shelving system 10 according to their specific needs or requirements. For example, as seen in FIG. 15, the shelving system 10 may comprise a first track 12 being adjacently disposed to a second track 12', the first track 12 and the second track 12' being coupled to the wall 1 so that the respective lateral ends of each track 12, 12' meet, thereby forming a common or single track. Disposed along the tracks 12, 12' are a plurality of uprights, namely a first upright 14, a second upright 14', and a third upright 14". Coupled to each of the uprights 14, 14', 14" are a corresponding plurality of brackets, specifically a first bracket 16 coupled to the first upright 14, a second bracket 16' coupled to the second upright 14', and a third bracket 16" coupled to the third upright 14". As detailed above, a plurality of frames 18, 18' are coupled to the plurality of brackets 16, 16', 16", with a first frame 18 coupled to the first bracket 16 and the second bracket 16', and a second frame 18' coupled to the second bracket 16' and the third bracket 16". Inserted into each of the frames 18, 18' are a plurality of shelf plates 56 which cooperate to form a single or continuous shelf space across the entire relative length of the shelving system 10. According to certain embodiments, each of the uprights 14, 14', 14" also a support a plurality of pegboards, namely a first pegboard 20 coupled to the first upright 14 and the second upright 14', and a second pegboard 20' coupled to the second upright 14' and the third upright 14". A plurality of goods or items can be placed upon the plurality of shelf plates 56, while a plurality of different attachments units described above may be removably coupled to the pegboards 20, 20'. It should be noted that the specific number of tracks (12), uprights (14), brackets (16), frames (18), and pegboards (20) shown in FIG. 15 are for illustrative purposes only and that fewer or additional components other than what is explicitly shown may be used without departing from the original spirit and scope of the current invention.

Figure 16A:
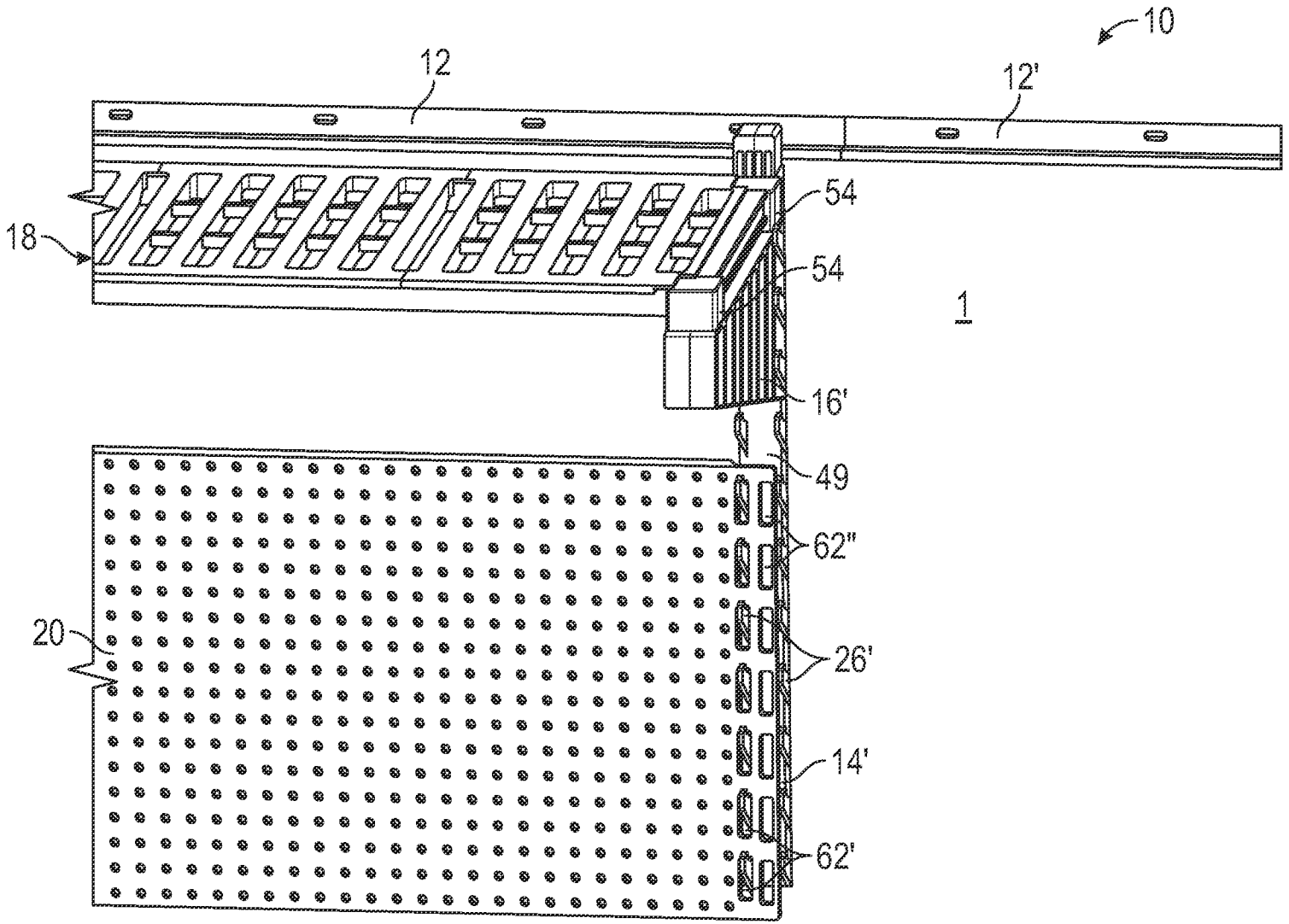
FIG. 16A is a magnified view of a right-hand portion of a first frame and a first pegboard of the shelving system of FIG. 15, the first frame being coupled to second bracket and the first pegboard being coupled to a second upright, respectively.

According to certain embodiments, a user selectively expands the shelving system 10 as seen in FIGS. 16A-16F. Turning to FIG. 16A, a magnified right-hand portion of the shelving system 10 of FIG. 15 can be seen which comprises a frame 18 coupled to a second bracket 16', the second bracket 16' itself being coupled to a second upright 14'. The frame 18 is coupled to each of the proximal pins 48 and the distal pins 48' disposed on the second bracket 16' within respective joints 54 of the frame 18. A pegboard 20 is also coupled to the second upright 14' via the hooks 26, the inside hook apertures 62' of the pegboard 20 specifically being disposed over the inside hooks 26' of the second upright 14', while the outside hook apertures 62" of the pegboard 20' are disposed within the gap 49 of the second upright 14'. As also seen in FIG. 16A, the second track 12' is coupled to the wall 1 so as to form one continuous track in cooperation with the first track 12.

Figure 16B:
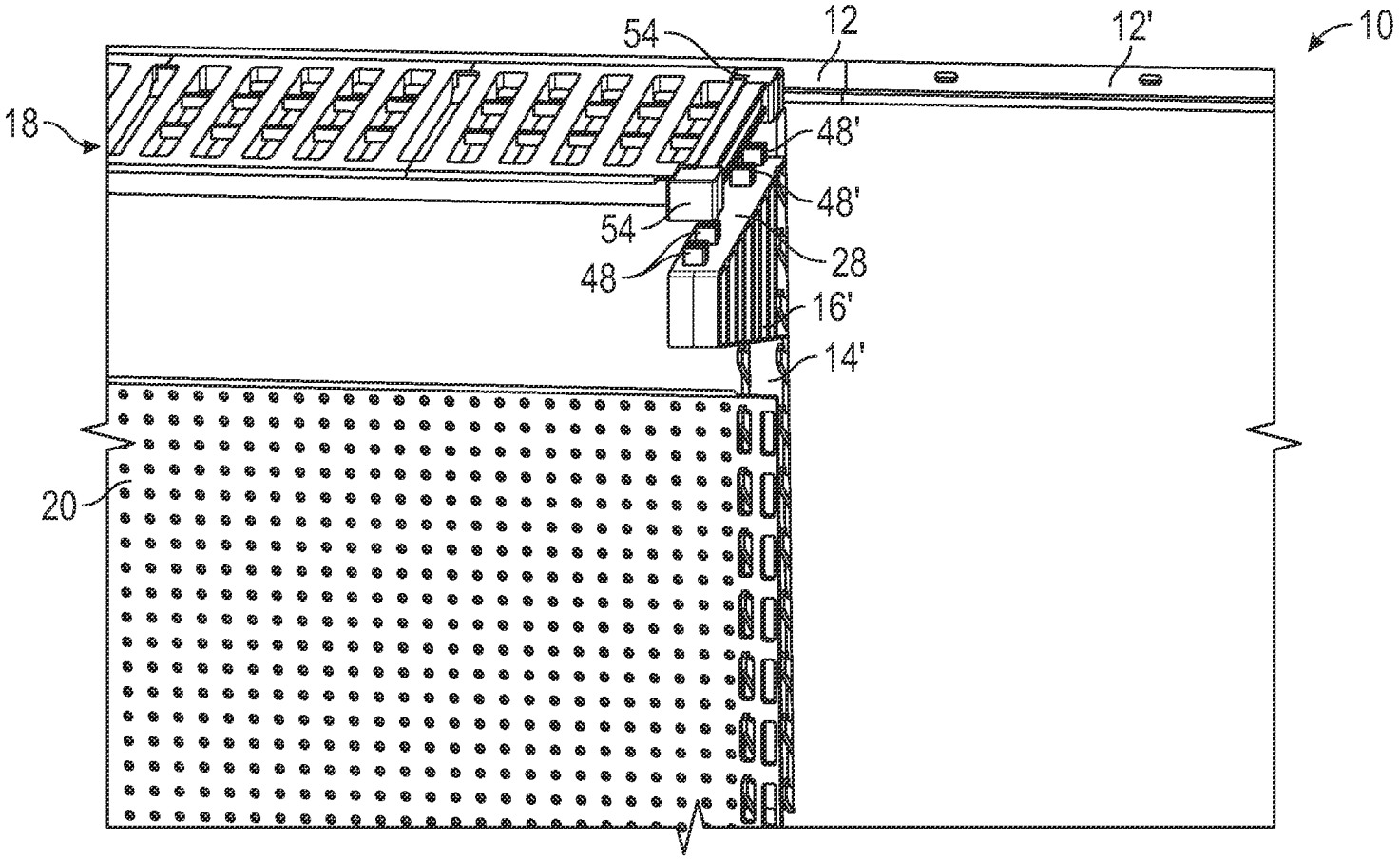
FIG. 16B is a magnified view following FIG. 16A after the first frame has been removed from the second bracket.
Figure 16C:
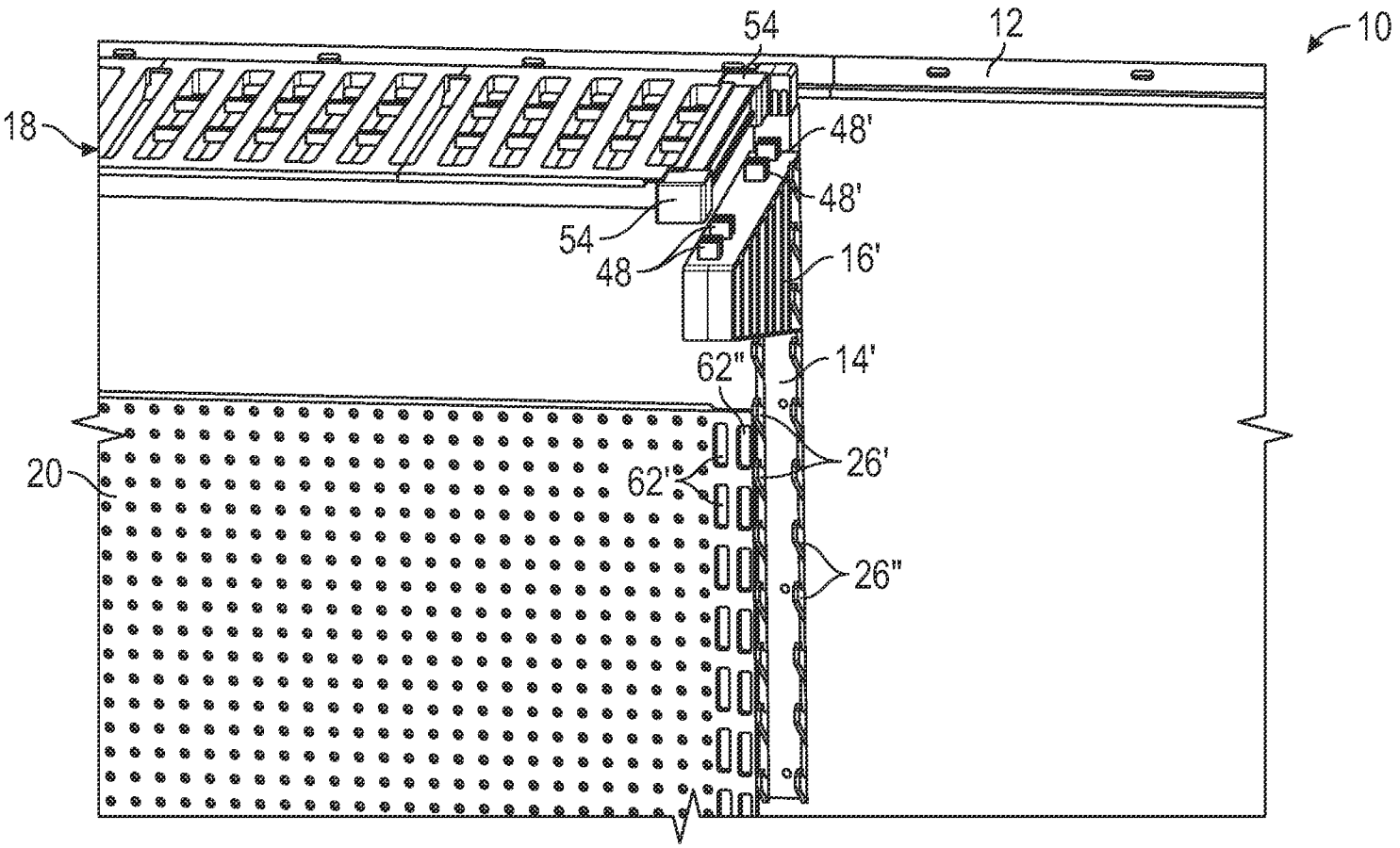
FIG. 16C is a magnified view following FIG. 16B after the first pegboard has been removed from the second upright.
Figure 16D:
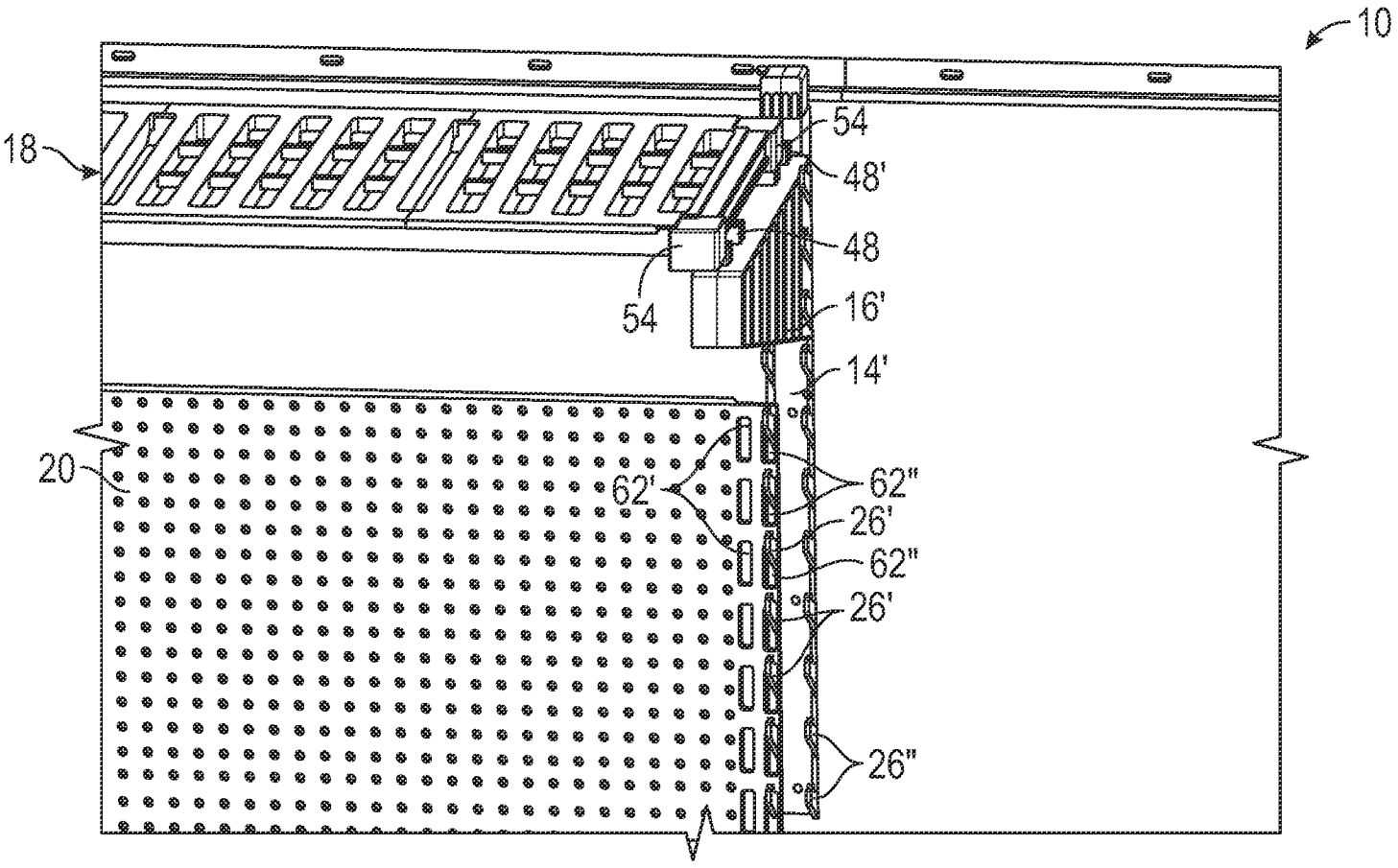
FIG. 16D is a magnified view following FIG. 16C after the first frame and the first pegboard have been recoupled to the second bracket and the second upright, respectively, the first frame being specifically coupled to only one distal pin and only one proximal pin of the bracket, and the first pegboard being specifically coupled to a first subset of a plurality of hooks disposed on the second upright.
Figure 16E:
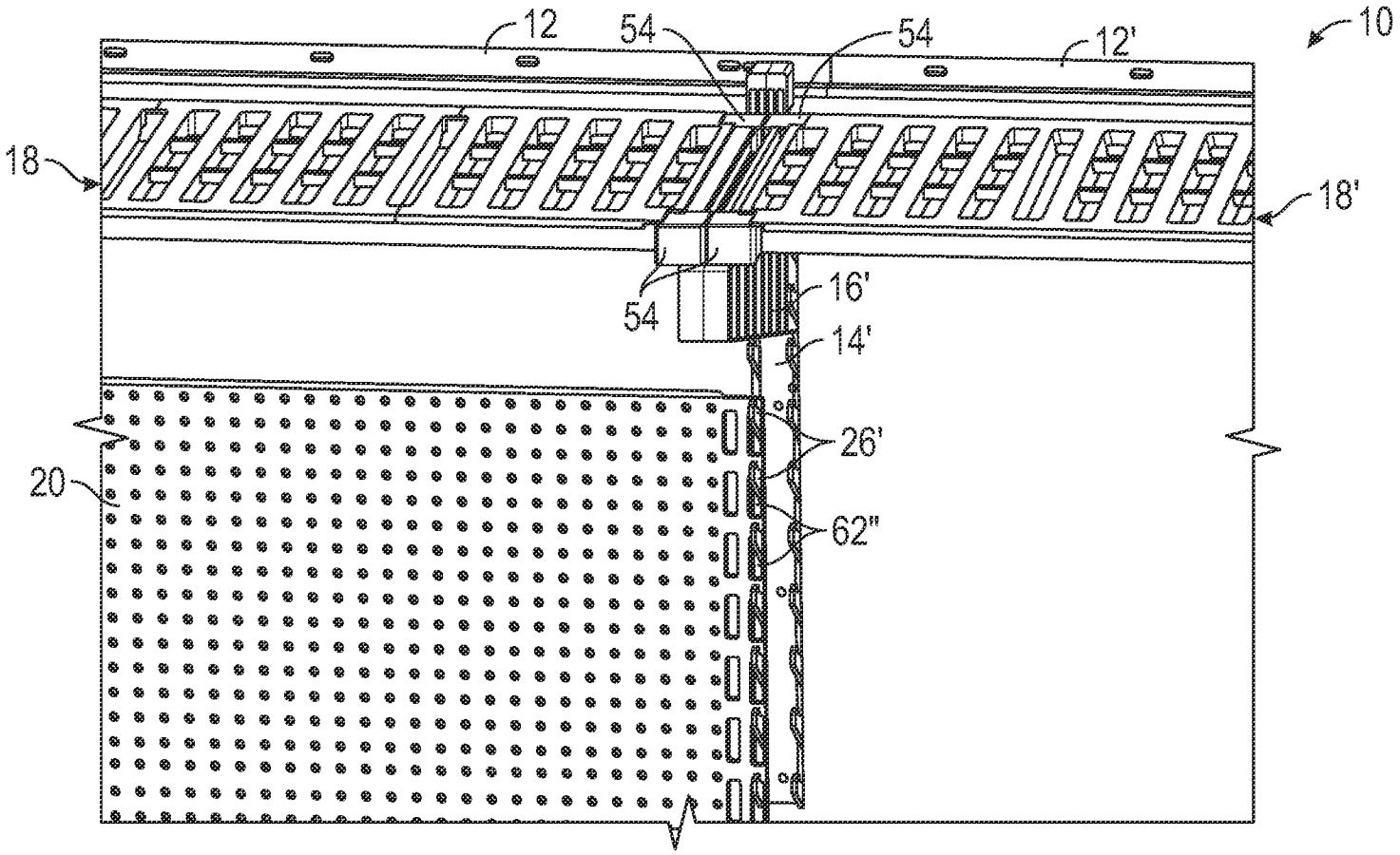
FIG. 16E is a magnified view following FIG. 16D after a second frame has been coupled to the second bracket, the second frame being specifically coupled to only one distal pin and only one proximal pin of the bracket.
Figure 16F:
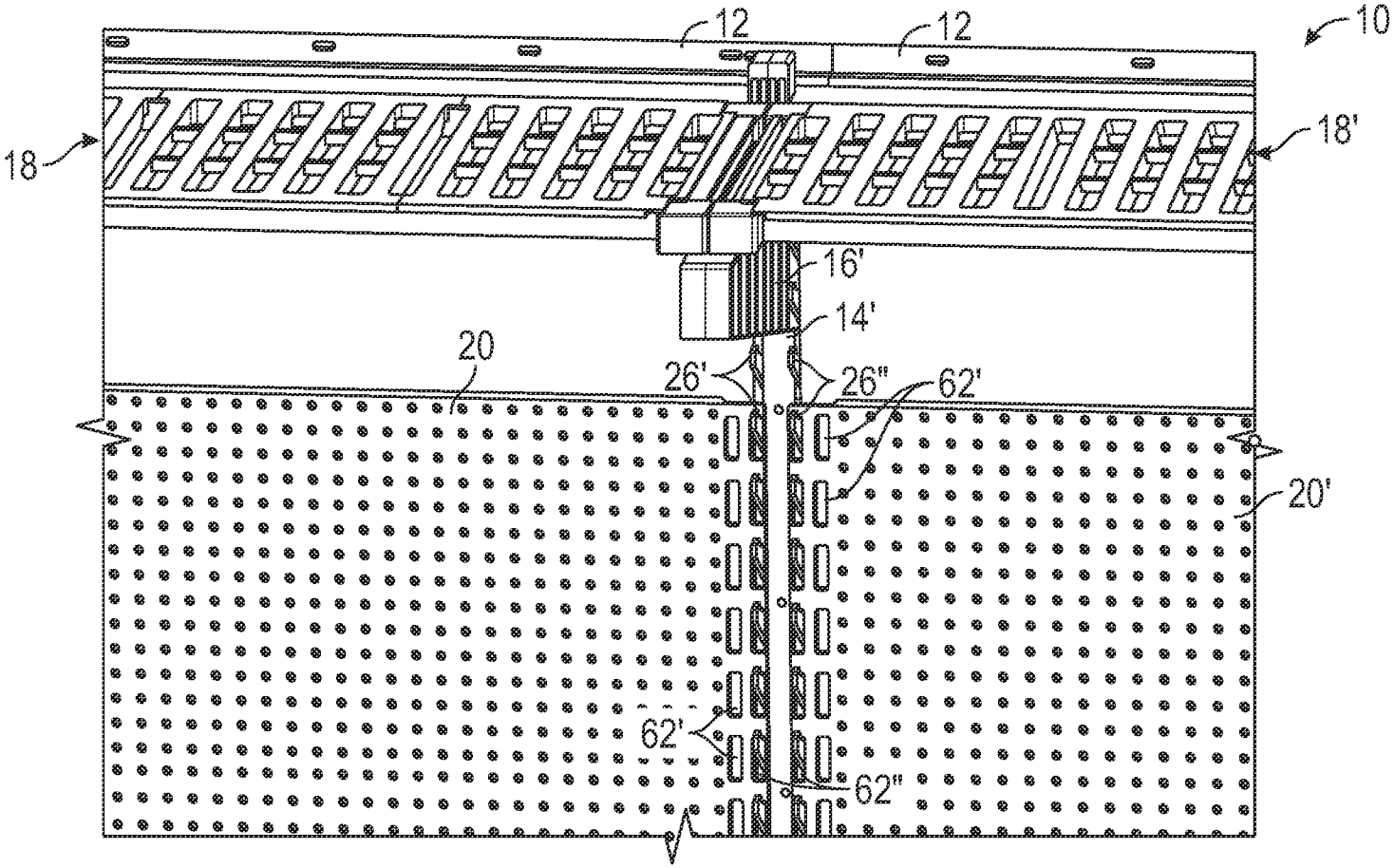
FIG. 16F is a magnified view following FIG. 16E after a second pegboard has been coupled to the second upright, the second pegboard being specifically coupled to a second subset of the plurality of hooks disposed on the second upright.

To adjust the shelving system 10, a user lifts the frame 18 off of the second bracket 16' as seen in FIG. 16B, according to certain embodiments. As the frame 18 is removed, the joints 54 of the frame 18 come off of the proximal pins 48 and the distal pins 48'. Here it can be seen that both pairs of proximal pins 48 and distal pins 48' are disposed in an off-set or off-center configuration, namely with one of the proximal pins 48 and one of the distal pins 48' being disposed on a left-hand portion of the top surface 28 of the second bracket 16', and the remaining proximal pin 48 and distal pin 48' being disposed on a right-hand portion of the top surface 28. The pegboard 20 is then removed from the second upright 14' by removing the plurality of inside hook apertures 62' of the pegboard 20 from the plurality of inside hooks 26' of the second upright 14' as seen in FIG. 16C. Next, the second upright 14' is slid or moved laterally down the length of the track 12 which also laterally moves the second bracket 16' by a corresponding or matching amount. With the second upright 14' and second bracket 16' laterally adjusted, the frame 18 and the pegboard 20 may then be recoupled to the second upright 14'. Specifically, as seen in FIG. 16D, the joints 54 of the frame 18 are brought down onto the top surface 28 of the second bracket 16' with each joint 54 being coupled to only one of the proximal and distal pins 48, 48', respectively, leaving a remaining one of the proximal and distal pins 48, 48' exposed. The pegboard 20 in turn is recoupled to the second upright 14', specifically with the inside hooks 26' of the second upright 14' now being inserted into the plurality of outside hook apertures 62" of the pegboard 20. As seen in FIG. 16E, a second frame 18' is added to the shelving system 10 by coupling the second frame 18' to the second bracket 16', specifically by disposing the joints 54 of the second frame 18' to the remaining or exposed proximal and distal pins 48, 48', respectively. A second pegboard 20' is added to the shelving system 10 according to certain embodiments as seen in FIG. 16F. Specifically, the second pegboard 20' is coupled to the second upright 14' by inserting the plurality of outside hooks 26" of the second upright 14' through the outside hook apertures 62" of the second pegboard 20'. As illustrated in FIG. 16F, the second upright 14' in this embodiment is used to support both the first pegboard 20 and the second pegboard 20', namely with the plurality of inside hooks 26' supporting the first pegboard 20, and with the plurality of outside hooks 26" supporting the second pegboard 20'. An opposing end of the second frame 18' is coupled to the third bracket 16" while an opposing end of the second pegboard 20 is likewise coupled to the hooks 26 of the third upright 14" in same manner above so as to form the expanded shelving unit seen in FIG. 15. In this manner, the shelving system 10 according to certain embodiments may be added to as needed by continuously adding additional uprights 14, brackets 16, frames 18, and pegboards 20 to the tracks 12 in the manner detailed above. After assembly, the user may dispose a plurality of goods or items on the plurality of the shelf plates 56 disposed across the one or more frames 18 as well as couple of any number of different attachments or units seen in FIGS. 11-14 to the one or more pegboards 20.

Figure 17A:
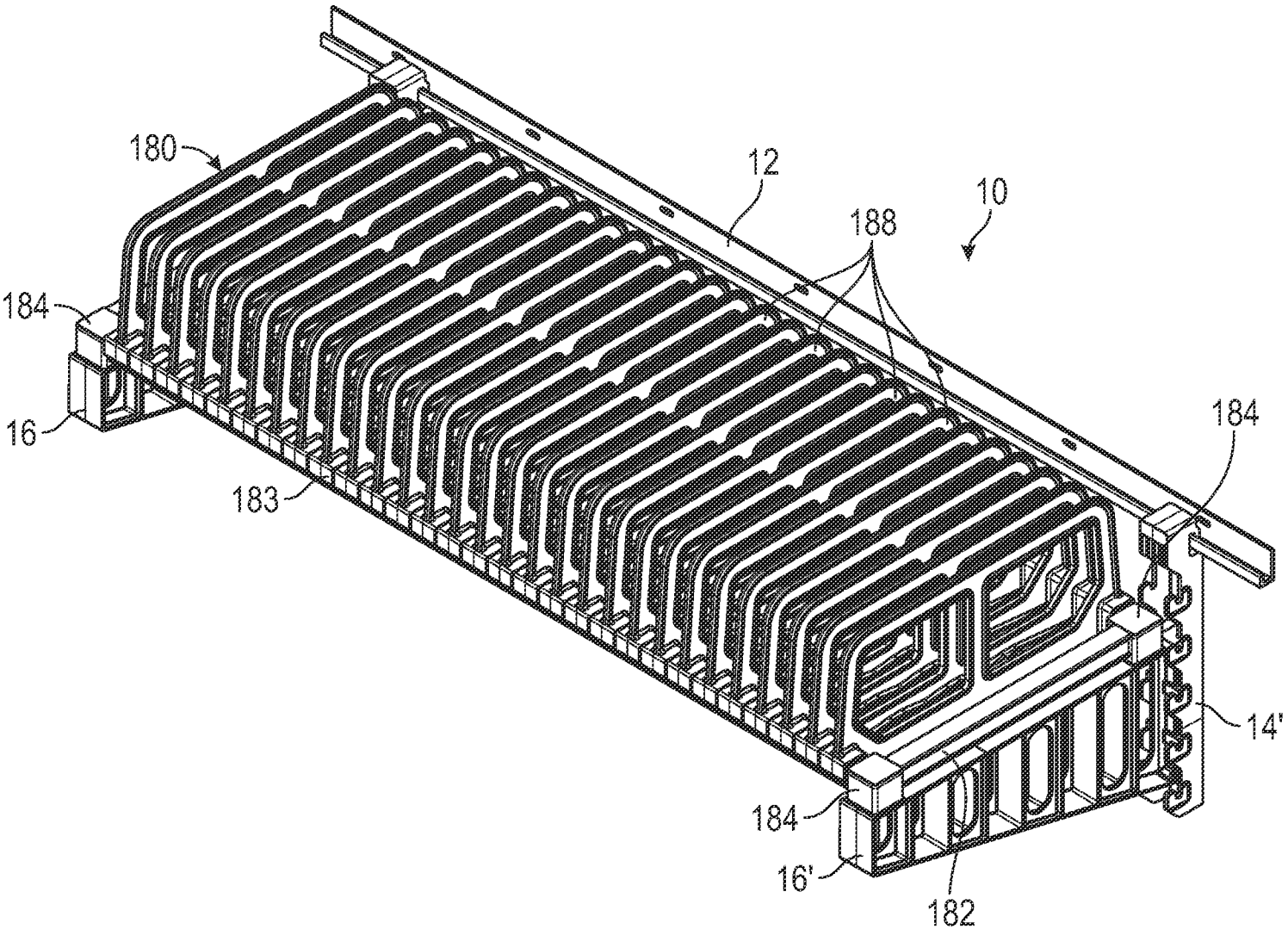
FIG. 17A is a perspective view of an alternative embodiment of the shelving system of the current invention comprising a plurality of drying racks.
Figure 17B:
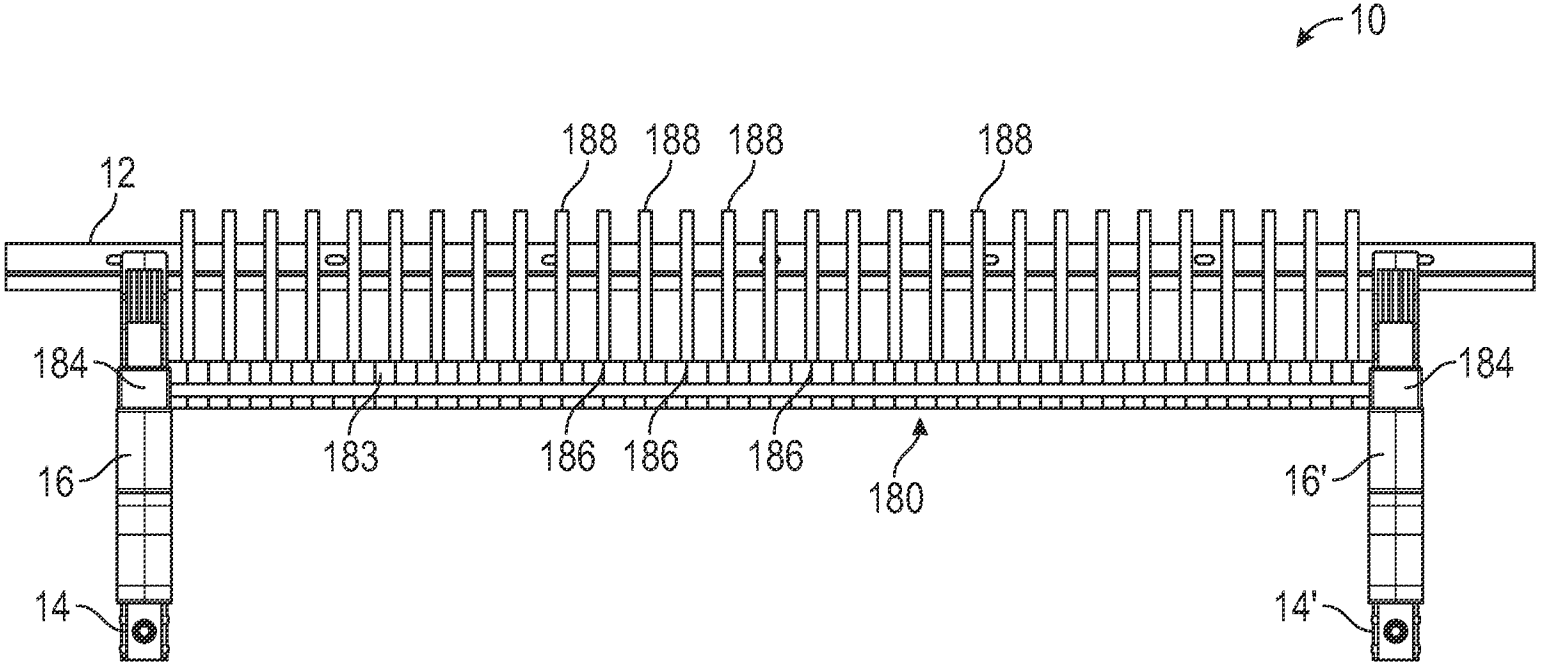
FIG. 17B is a front elevational view of the shelving system of FIG. 17A.
Figure 17C:
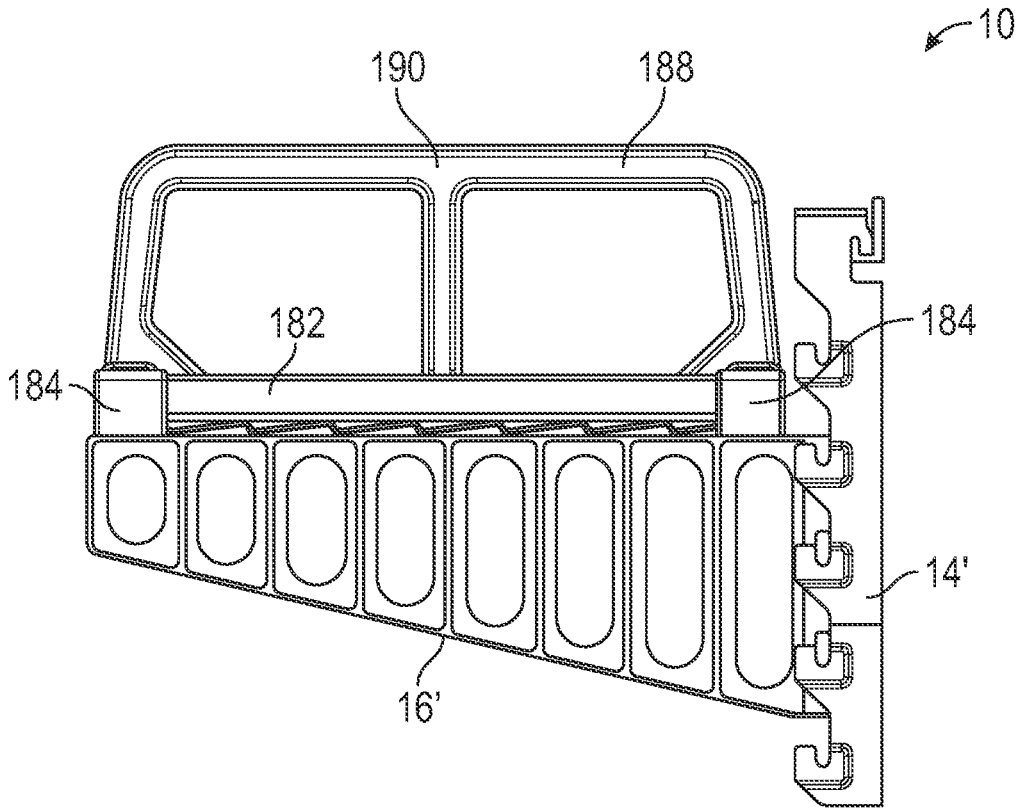
FIG. 17C is a right side elevational view of the shelving system of FIG. 17A.
Figure 18:
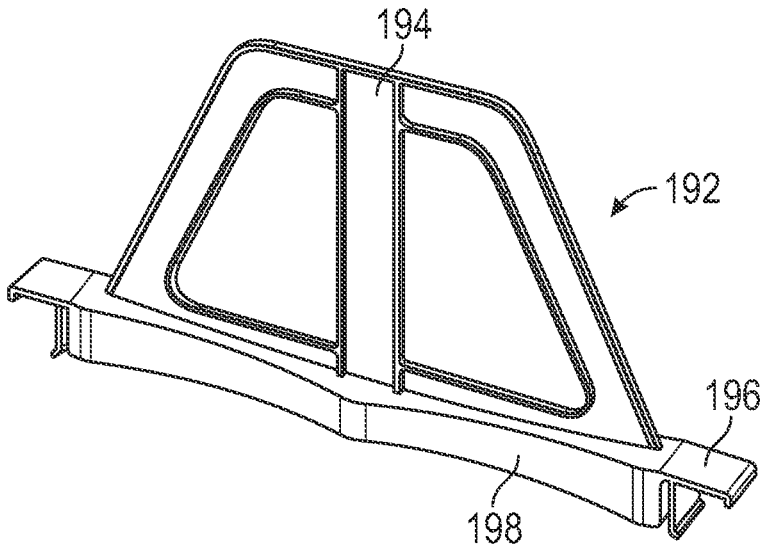
FIG. 18 is a perspective view of an alternative embodiment of a drying rack which may be used in the shelving system of FIG. 17A.

While FIGS. 15-16F show an expanded shelving system 10 comprising one or more frames 18, 18' that each comprise a plurality of shelf plates 56, according to certain other embodiments a drying rack frame 180 is coupled to a plurality of brackets 16, 16' so as to provide a means for drying a plurality of dishes, cookware, or other items thereon. As seen in FIGS. 17A-17C, the drying rack frame 180 comprises a support 183 with a lateral edge 182 disposed at either lateral end, each edge 182 comprising a pair of joints 184 configured to interact or engage with the pins 48, 48' of the brackets 16, 16' as detailed above. The support 183 comprises a plurality of slots 186 defined across its upward facing surface, each slot 186 configured to accommodate or engage with a drying rack 188 that is inserted or fitted therein. According to certain embodiments, each drying rack 188 comprises a substantially rectangular shaped body 190 which projects upward from the surface of the support 184 as seen in FIG. 17C. However, in certain other embodiments, the drying rack may comprise any shape or configuration suitable for supporting dishware or other items there between. For example, an alternative drying rack 192 seen in FIG. 18 comprises a substantially trapezoidal shaped body 194. FIG. 18 further shows that each drying rack 188, 192 comprises a horizontal base 196 that forms a flush surface when multiple drying racks 188, 192 are adjacently inserted into the support 183. Each drying rack 188, 192 further comprises a tab 198 which extends vertically downward from the base 196. The tab 198 is configured to be inserted into one of the plurality of slots 186 defined in the support 183 so that a user may couple the drying rack 188, 192 to the support 183 by first aligning the tab 198 with a selected one of the plurality of slots 186 and then pushing the drying rack 188, 192 downward into the support 183 until the base 198 makes contact with the upward surface of the support 183. With the drying racks 188, 192 coupled to the support 183, a user may place a dish, tray, and/or any other number of items between adjacent drying racks 188, 192 which support or hold the item in a static position, thereby allowing the item to air or drip dry. As seen in FIGS. 17A and 17B, a plurality of drying racks 188 are inserted into each of the plurality of slots 186, thereby providing the user with the ability to dispose a dish anywhere along the length of the drying rack frame 180. However in certain other embodiments, fewer or additional drying racks 188 other than what is explicitly shown may be inserted into the support 183. For example, if a large item is to be disposed on the drying rack frame 180, the user may remove one or more drying racks 188 from the drying rack frame 180 so that the large item may be accommodated thereon.

Figure 19A:
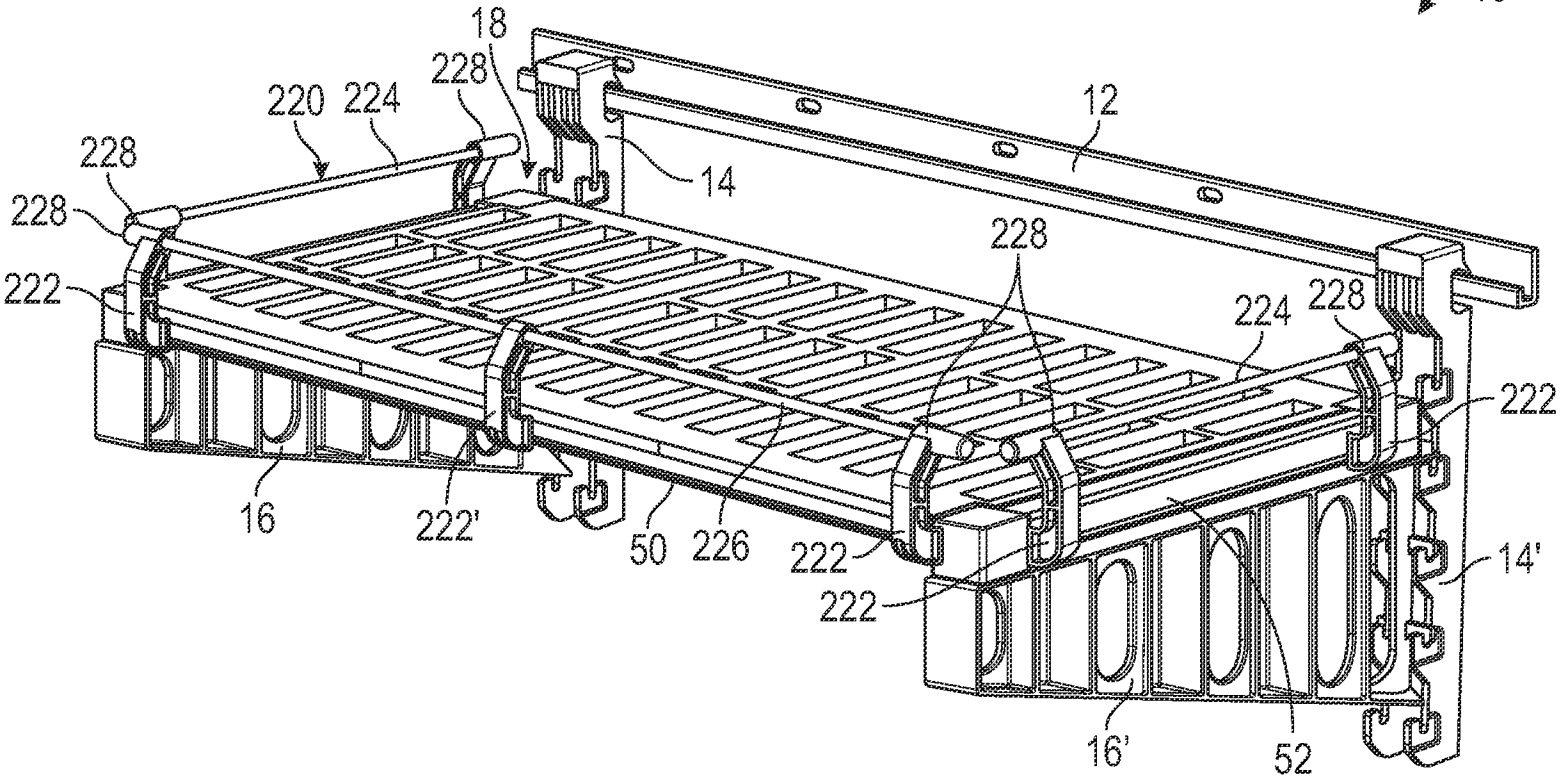
FIG. 19A is a perspective view of an alternative embodiment of the shelving system of the current invention comprising a plurality of barriers disposed around the edges of a frame.
Figure 19B:
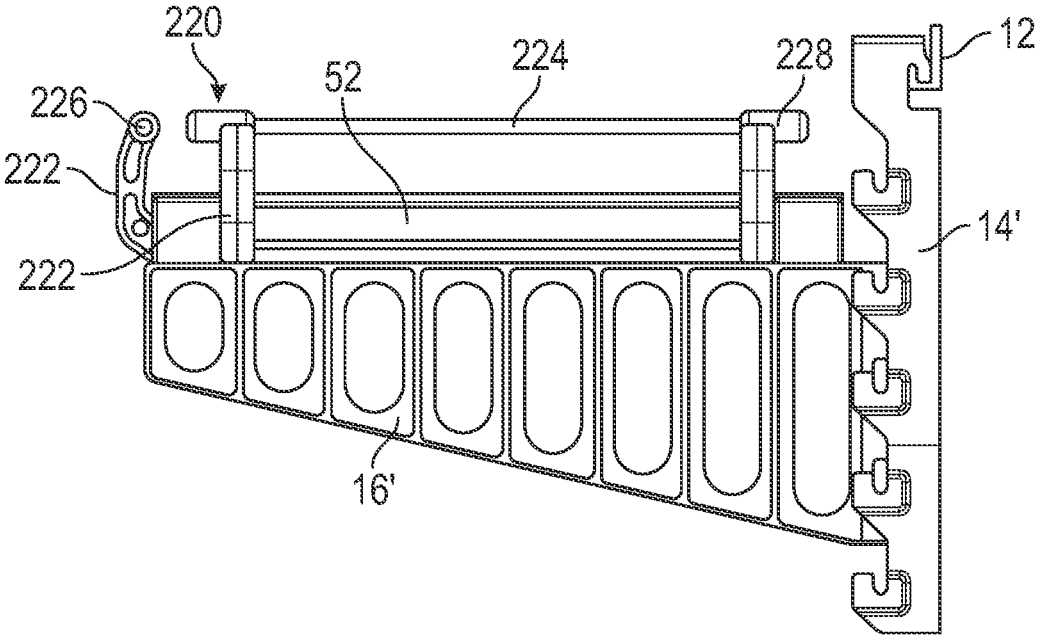
FIG. 19B is a right side elevational view of the shelving system of FIG. 19A.
Figure 19C:
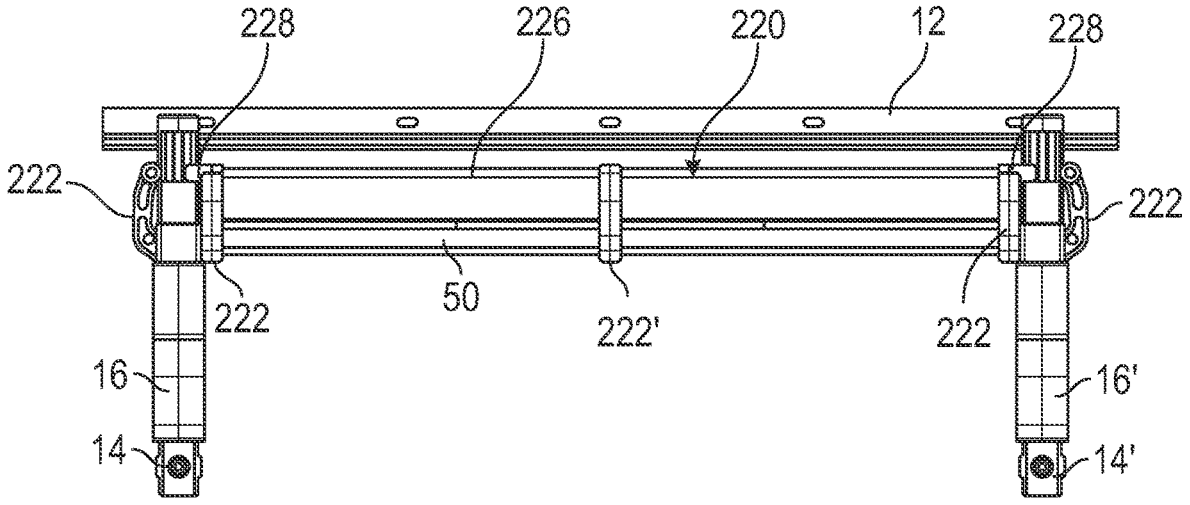
FIG. 19C is a front elevational view of the shelving system of FIG. 19A.
Figure 20:
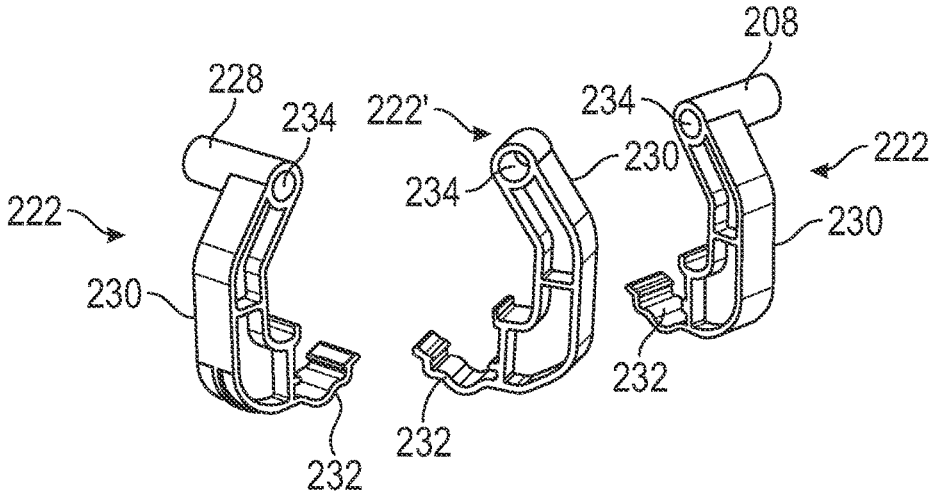
FIG. 20 are a series of perspective views of two corner posts and a center post used in the shelving system of FIG. 19A.

In certain embodiments, the shelving system 10 further comprises a plurality of barriers 220 disposed around the outer edges of the frame 18 as seen in FIGS. 19A-20. Each barrier 220 comprises a plurality of corner posts 222 and/or center posts 222' which are removably coupled to either the longitudinal edges 50 or the lateral edges 52 of the frame 18. Each of the plurality of posts 222, 222' are configured to accommodate a rail 224, 226 therein, a lateral rail 224 being used along the lateral edges 52 of the frame 18, and a longitudinal rail 226 being used along the longitudinal edges 50 of the frame 18. According to certain embodiments, a barrier 220 comprises a rail 224, 226 with at least one corner post 222 disposed at either end of the rail 224, 226. For example, as seen along the lateral edges 52 of the frame 18 in FIGS. 19A and 19B, the barrier 220 comprises a lateral rail 224 coupled to a corner post 222 at each end so that the lateral rail 224 is suspended above the lateral edge 52 itself. Alternatively, as seen along the longitudinal edge 50 of the frame 18 in FIGS. 19A and 19C, the barrier 220 comprises a longitudinal rail 226 coupled to a corner post 222 at either end with a center post 222' disposed substantially there between so that the longitudinal rail 226 is suspended above the longitudinal edge 50 itself. As seen in FIG. 19A, with a barrier 220 coupled to one of the longitudinal edges 50 and both lateral edges 52, a "fence" or physical boundary is formed along three sides of the frame 18. When objects or items are placed on the shelf plates 56 of the shelving system 10, the plurality of barriers 220 serve to keep said items from sliding, rolling, or otherwise falling off of the frame 18 portion of the shelving system 10.

Turning to FIG. 20, greater detail of the corner posts 222 and the center posts 222' is seen. Both the corner posts 222 and the center posts 222' comprise a substantially "J" shaped body 230 with a clamp 232 disposed at its lower end and an aperture 234 defined through its upper end. The clamp 232 is configured to form a friction or snap fit with the edges 50, 52 so that a user may easily and repeatedly couple the posts 222, 222' to any position along the respective lengths of either a longitudinal edge 50 or a lateral edge 52 of the frame 18, according to certain embodiments. The aperture 234 of each post 222, 222' is sized and shaped to accommodate the diameter of either a lateral rail 224 or a longitudinal rail 226 therein. Each corner post 222 further comprises a stop 228 extending off of one lateral end of the aperture 234 which, when a rail 224, 226 is disposed therein, serves to block or prevent the rail 224, 226 from moving relative to the corner post 222.

Figure 21:
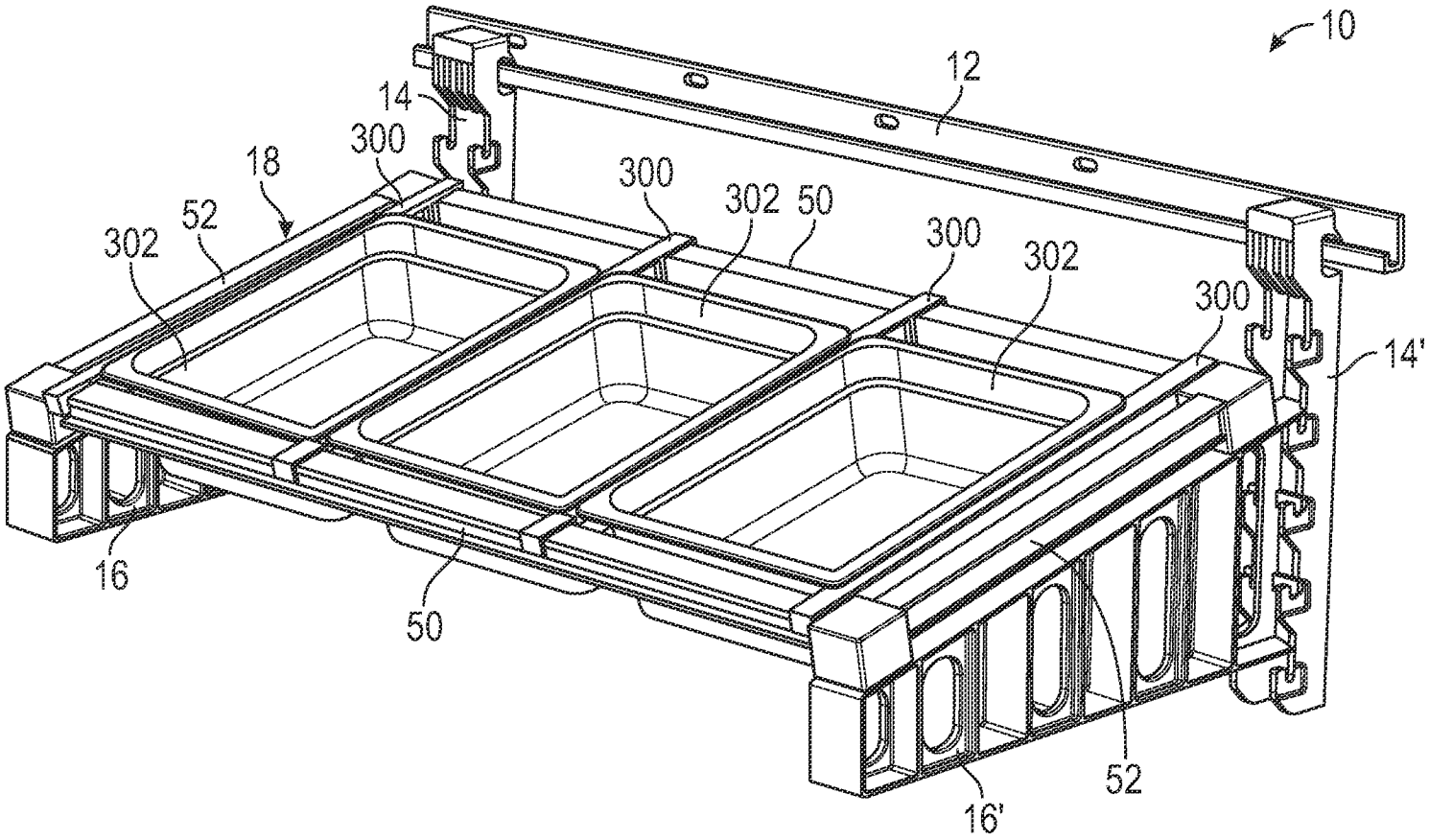
FIG. 21 is a perspective view of an alternative embodiment of the shelving system of the current invention comprising a plurality of partitions and a plurality of bins disposed within a frame.
Figure 22:
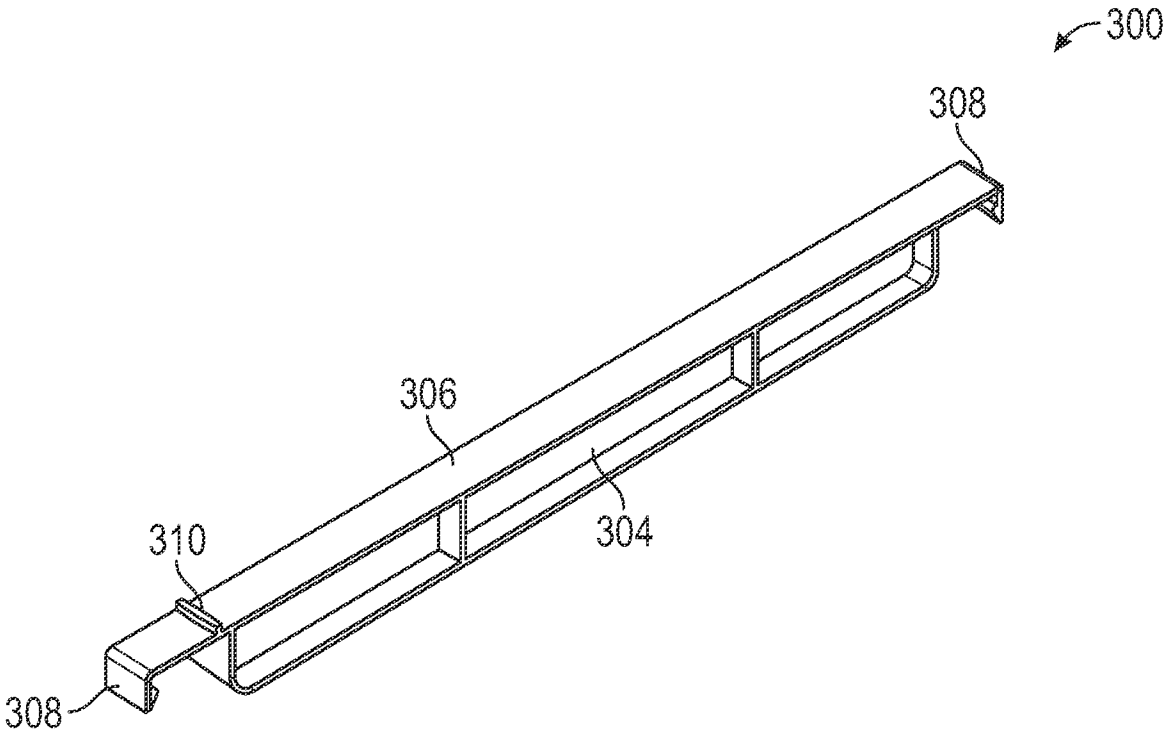
FIG. 22 is a perspective view of a partition used within the shelving system of FIG. 21.

In certain embodiments, the shelving system 10 further comprises a plurality of partitions 300 disposed in the frame 18 as seen FIGS. 21 and 22. For example, a plurality of removable and adjustable partitions 300 are inserted into the frame 18, specifically with each partition 300 extending between the parallel pair of longitudinal edges 50 of the frame 18. Greater detail of the partition 300 is seen in FIG. 21 where the partition 300 comprises a pair of inverted "U" shaped feet 308 disposed on either end of an elongated body 304. The elongated body 304 also comprises a top surface 306 along its longitudinal length, the top surface 306 having a stop or bump 310 disposed near at least one lateral end of the elongated body 304. To insert a partition 300 into the frame 18 the user aligns the partition 300 substantially perpendicular relative to the longitudinal edges 50 of the frame 18 so that each of the feet 308 are disposed over the respective longitudinal edges 50. The feet 308 are then brought down onto the longitudinal edges 50, the feet 308 forming a friction or snap fit with each longitudinal edge 50. Each partition 300 may be slid laterally across the longitudinal edges 50 to a desired position within the frame 18. One or more bins 302 may then be incorporated into the shelving system 10 by disposing or resting their corresponding edges, lip, or brim on the top surfaces 306 of adjacently disposed partitions 300, the partitions 300 thereby forming a support structure to allow each bin 302 to hang therefrom. A user may place items or goods into each bin 302 as needed with the stop or bump 310 on each top surface 306 preventing forward or proximal movement of the bin 302 relative to the rest of the shelving system 10.

Many alterations and modifications may be made by those having ordinary skill in the art without departing from the spirit and scope of the embodiments. Therefore, it must be understood that the illustrated embodiment has been set forth only for the purposes of example and that it should not be taken as limiting the embodiments as defined by the following embodiments and its various embodiments.

Therefore, it must be understood that the illustrated embodiment has been set forth only for the purposes of example and that it should not be taken as limiting the embodiments as defined by the following claims. For example, notwithstanding the fact that the elements of a claim are set forth below in a certain combination, it must be expressly understood that the embodiments includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the embodiments is explicitly contemplated as within the scope of the embodiments.

The words used in this specification to describe the various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the embodiments.

We claim:

1. A shelving system comprising:

a track;

a first upright removably coupled to the track;

a second upright removably coupled to the track;

a first bracket removably coupled to the first upright;

a second bracket removably coupled to the second upright;

a frame removably coupled between the first upright and the second upright; and a pegboard removably coupled between the first upright and the second upright, wherein the pegboard comprises a plurality of hook apertures configured to engage a first subset of a plurality of hooks disposed on each of the first upright and the second upright, and wherein the first bracket and the second bracket each comprise a plurality of flanges configured to engage with a corresponding plurality of the grooves defined in a second subset of the plurality of hooks disposed on each of the first upright and the second upright.

2. The shelving system of claim 1 wherein the frame comprises a pair of longitudinal edges and a pair of lateral edges, and wherein the pair of lateral edges are each configured to removably couple to the first bracket and the second bracket, respectively.

3. The shelving system of claim 1 further comprising at least one shelf plate removably inserted into the frame.

4. The shelving system of claim 1 further comprising a further frame or a further pegboard coupled between the first upright and the second upright.

5. The shelving system of claim 1 wherein the plurality of hooks disposed on each of the first upright and the second upright are disposed along their respective vertical heights.

6. The shelving system of claim 2 wherein each of the lateral edges of the frame comprises at least two joints, wherein the first bracket and the second bracket each comprise a plurality of proximal pins and a plurality of distal pins disposed on a top surface, and wherein the at least two joints of each of the lateral edges are configured to removably couple to at least one of the plurality of proximal pins or at least one of the plurality of distal pins when the lateral edges of the frame are disposed on the top surfaces of the first and second brackets.

7. The shelving system of claim 1 wherein the pegboard comprises:

a body; and a plurality of holes defined in the body, wherein the plurality of hook apertures are defined in the body.

8. The shelving system of claim 7 further comprising at least one attachment unit removably coupled to the pegboard, wherein the at least one attachment unit comprises a wire frame coupled to a cup, a basket, a plurality of pegs, or a bin.

9. The shelving system of claim 8 wherein the wire frame comprises at least one reversible attachment, the at least one reversible attachment comprising an eye defined in a first end of the at least one reversible attachment and a tab disposed in a second end of the at least one reversible attachment.

10. The shelving system of claim 1 further comprising at least one drying rack removably inserted into the frame.

11. The shelving system of claim 1 further comprising at least one barrier removably coupled to the frame.

12. The shelving system of claim 11 wherein the at least one barrier comprises:

a plurality of posts; and a rail disposed between the plurality posts, wherein each of the plurality of posts comprise a clamp configured to couple to the frame.

13. The shelving system of claim 1 further comprising at least one partition removably inserted into the frame.

14. The shelving system of claim 13 further comprising at least one bin removably inserted into the frame and disposed on a top surface of the at least one partition.

15. The shelving system of claim 1 further comprising at least one cutting board removably coupled to the first bracket or the second bracket.

16. A method for assembling a shelving system, the method comprising:

removably coupling a first upright to a first selected location along a length of a track;

removably coupling a second upright to a second selected location along the length of the track;

removably coupling a first bracket to the first upright;

removably coupling a second bracket to the second upright;

removably coupling a frame to the first upright and the second upright; and removably coupling a pegboard to the first upright and the second upright, wherein removably coupling the pegboard to the first upright and the second upright comprises engaging a plurality of hook apertures defined in the pegboard to a first subset of a plurality of hooks disposed on each of the first upright and the second upright, wherein removably coupling the first bracket to the first upright and the second bracket to the second upright comprises engaging a plurality of flanges disposed on each of the first bracket and the second bracket with a corresponding plurality of grooves defined in a second subset of the plurality of hooks disposed on each of the first upright and the second upright, respectively.

17. The method of claim 16 further comprising removably coupling the frame to the first bracket and the second bracket.

18. The method of claim 17 wherein removably coupling the frame to the first bracket and the second bracket comprises:

removably coupling a first joint of the frame to at least one distal pin disposed on a top surface of the first bracket;

removably coupling a second joint of the frame to at least one proximal pin disposed on the top surface of the first bracket;

removably coupling a third joint of the frame to at least one distal pin disposed on a top surface of the second bracket; and removably coupling a fourth joint of the frame to at least one proximal pin disposed on the top surface of the second bracket.

19. The method of claim 17 further comprising inserting at least one shelf plate into the frame.

20. The method of claim 16 further comprising removably coupling at least one attachment unit to the pegboard, the at least one attachment unit comprising a cup, a basket, a plurality of pegs, or a bin.

21. The method of claim 16 further comprising removably coupling a further frame to the first upright and the second upright; or removably coupling a further pegboard to the first upright and the second upright.

* * * * *